US008356735B1

(12) United States Patent
Drakeford

(10) Patent No.: US 8,356,735 B1
(45) Date of Patent: Jan. 22, 2013

(54) METHOD AND APPARATUS FOR PUTTING ON AND TAKING OFF SOCKS OR STOCKINGS

(76) Inventor: Melvin L. Drakeford, New York, NY (US)

( * ) Notice: Subject to any disclaimer, the term of this patent is extended or adjusted under 35 U.S.C. 154(b) by 0 days.

(21) Appl. No.: 13/524,654

(22) Filed: Jun. 15, 2012

(51) Int. Cl.
*A47G 25/90* (2006.01)
*A47G 25/00* (2006.01)

(52) U.S. Cl. ..... 223/112

(58) Field of Classification Search ..... 223/111
See application file for complete search history.

(56) References Cited

U.S. PATENT DOCUMENTS

| | | | | |
|---|---|---|---|---|
| 2,894,669 | A * | 7/1959 | Silken | 223/111 |
| 2,903,170 | A * | 9/1959 | Ahn | 223/111 |
| 2,982,453 | A * | 5/1961 | Zicarelli | 223/112 |
| 3,310,209 | A | 3/1967 | Clauss | 223/111 |
| 3,401,856 | A | 9/1968 | Berlin | 223/111 |
| 3,853,252 | A | 12/1974 | Scianimanico | 223/111 |
| 4,238,061 | A | 12/1980 | Marchetti | 223/111 |
| 4,260,083 | A | 4/1981 | Aslin | 223/111 |
| 4,620,737 | A | 11/1986 | Sanger | 294/99.2 |
| 4,637,533 | A | 1/1987 | Black | 223/112 |
| 4,651,909 | A | 3/1987 | Banting | 223/111 |
| D310,908 | S | 10/1990 | Santore | D2/642 |
| 5,050,783 | A | 9/1991 | Hunter | 223/112 |
| D321,427 | S | 11/1991 | Barrick | D2/641 |
| 5,706,988 | A | 1/1998 | Moore | 223/111 |
| 6,536,636 | B1 * | 3/2003 | McDonniel | 223/111 |
| 6,834,785 | B2 | 12/2004 | Kneth | 223/112 |
| 6,932,252 | B2 | 8/2005 | Simmons | 223/111 |
| 7,975,886 | B2 * | 7/2011 | McAllister et al. | 223/111 |
| 2010/0200622 | A1 * | 8/2010 | Fusaro | 223/111 |

FOREIGN PATENT DOCUMENTS

| | | | |
|---|---|---|---|
| DE | 19837924 | 9/1997 | 178/48 |
| DE | 19803503 | 1/1998 | 285/115 |
| DE | 19830277 | 7/1998 | 416/13 |

OTHER PUBLICATIONS

"Enrichments—Special Purpose Products for Enhanced Living", 2009, Patterson Medical, Sammons®, Preston, © 2009 Patterson Medical Products, Inc., p. 22, "Reachers & Dressing Aids".

* cited by examiner

*Primary Examiner* — Ismael Izaguirre
(74) *Attorney, Agent, or Firm* — Walter J. Tencza, Jr.

(57) ABSTRACT

An apparatus which may include a first subsection having a first top end and a second top end, and a second subsection having a first top end and a second top end. A first line from the first top end of the first subsection to the second top end of the first subsection, and a second line from the first top end of the second subsection to the second top end of the second subsection, may be at a first angle with respect to the second line. The second top end of the first subsection may be fixed to the first top end of the second subsection. The apparatus may further include a first hollow tube, and a device for moving the first hollow tube along the first and second subsections to put a sock on or to take a sock off a leg of a person.

22 Claims, 22 Drawing Sheets

METHOD AND APPARATUS FOR PUTTING ON AND TAKING OFF SOCKS OR STOCKINGS

FIELD OF THE INVENTION

This invention relates to improved methods and apparatus concerning putting on or taking off socks or stockings.

BACKGROUND OF THE INVENTION

Many people have difficulty with putting on and taking off their socks, such as people suffering from arthritis, cerebral palsy, muscular dystrophy, and individuals rehabilitating from knee or hip surgeries. Some individual are unable to bend down, lean forward or lack sufficient flexibility/strength in their hands or legs to put on or take off their socks.

There are various devices known in the prior art for putting on and/or taking off socks or stockings that have been constructed to assist persons who have limited or restricted capabilities. These known devices frequently use manually operated tools that require flexibility by the user.

SUMMARY OF THE INVENTION

The present invention in one or more embodiments provides an apparatus which may include a first subsection having a first top end and a second top end, and a second subsection having a first top end and a second top end. There may be or may be defined a first line from the first top end of the first subsection to the second top end of the first subsection, and there may be or may be defined a second line from the first top end of the second subsection to the second top end of the second subsection. The first line may be at a first angle with respect to the second line. The second top end of the first subsection may be fixed to the first top end of the second subsection.

The apparatus may further include a first hollow tube, and a device for moving the first hollow tube along the first subsection and the second subsection. The first hollow tube, the first subsection, and the second subsection may be configured so that at least a portion of a foot of a leg of a person, including toes of the foot of the leg of a person, can be placed on the second subsection, while an ankle portion of the leg of the person is at the same time placed on the first subsection and while at the same time a portion of the leg of the person lies inside of the first hollow tube. The first angle may be greater than about ninety degrees, and may be between ninety degrees and one hundred and eighty degrees.

The first subsection and the second subsection may together form a channel into which the leg of the person can be placed. The device for moving the first hollow tube along the first subsection and the second subsection may include a motor, and a threaded rod connected to the motor so that the motor is configured to rotate the threaded rod in order to move the first hollow tube along the first subsection and the second subsection.

The first subsection may be in the shape of a hollow substantially cylindrical tube which has been substantially cut in half; and the second subsection may be in the shape of a curved hollow tube which has been substantially cut in half. The first subsection may have a first slot, the second subsection may have a second slot. The first slot and the second slot may join together in a first overall continuous slot.

The first hollow tube may be moved along the first subsection and the second subsection by the device for moving the first hollow tube via a first pin having a first end which is connected to the first hollow tube and a second end which rides in the first overall continuous slot. The first subsection may have a third slot, and the second subsection may have a fourth slot. The third slot and the fourth slot may join together in a second overall continuous slot. The first hollow tube may be moved along the first subsection and the second subsection by the device for moving the first hollow tube via a second pin having a first end which is connected to the first hollow tube and a second end which rides in the second overall continuous slot.

The apparatus may further include a first wheel, and a second wheel, wherein the first and the second wheel are connected to the second subsection so that the first and the second wheel rotate about a first axis with respect to the second subsection. The apparatus may include a third wheel, and a fourth wheel, wherein the third and the fourth wheel are connected to second subsection a distance away from the first wheel and the second wheel, so that the third and the fourth wheel rotate about a second axis with respect to the second subsection.

The apparatus may further include a stabilizing device which extends between the first axis and the second axis, so that when the first wheel and the second wheel are in contact with a ground surface, the third wheel and the fourth wheel are prevented from making contact with the ground surface by the stabilizing device.

A method is provided, in one or more embodiments, which may include using an apparatus to put a sock on a leg of a person or to take a sock off a leg of a person. The apparatus may be as previously described. The method may include attaching the sock to the first hollow tube, and moving the first hollow tube to cause the sock to be put on the leg of the person. The method may further include moving the first hollow tube to cause the sock to be taken off of the leg of the person after the sock has been put on the leg of the person.

One or more embodiments of the present invention are configured for individuals who have difficulty with and for many individuals who are unable to put on or take off their socks or stockings by themselves. One or more embodiments of the present invention allow physically limited persons to put on and take off a sock(s) or stocking via a power driven mechanism such as a motor. In at least one embodiment, where a power driver mechanism such as a motor is used, the motor may make it much easier to put on and take off a sock or stocking, than in a manual manner. A power driven mechanism also requires less dexterity for a person to operate.

It is possible, in one or more embodiments of the present invention to have a manual apparatus which does not require a motor or a power driven mechanism, however a power driven mechanism or device, such as a motor, in one embodiment is preferred.

DETAILED DESCRIPTION OF THE DRAWINGS

Figure 1A:
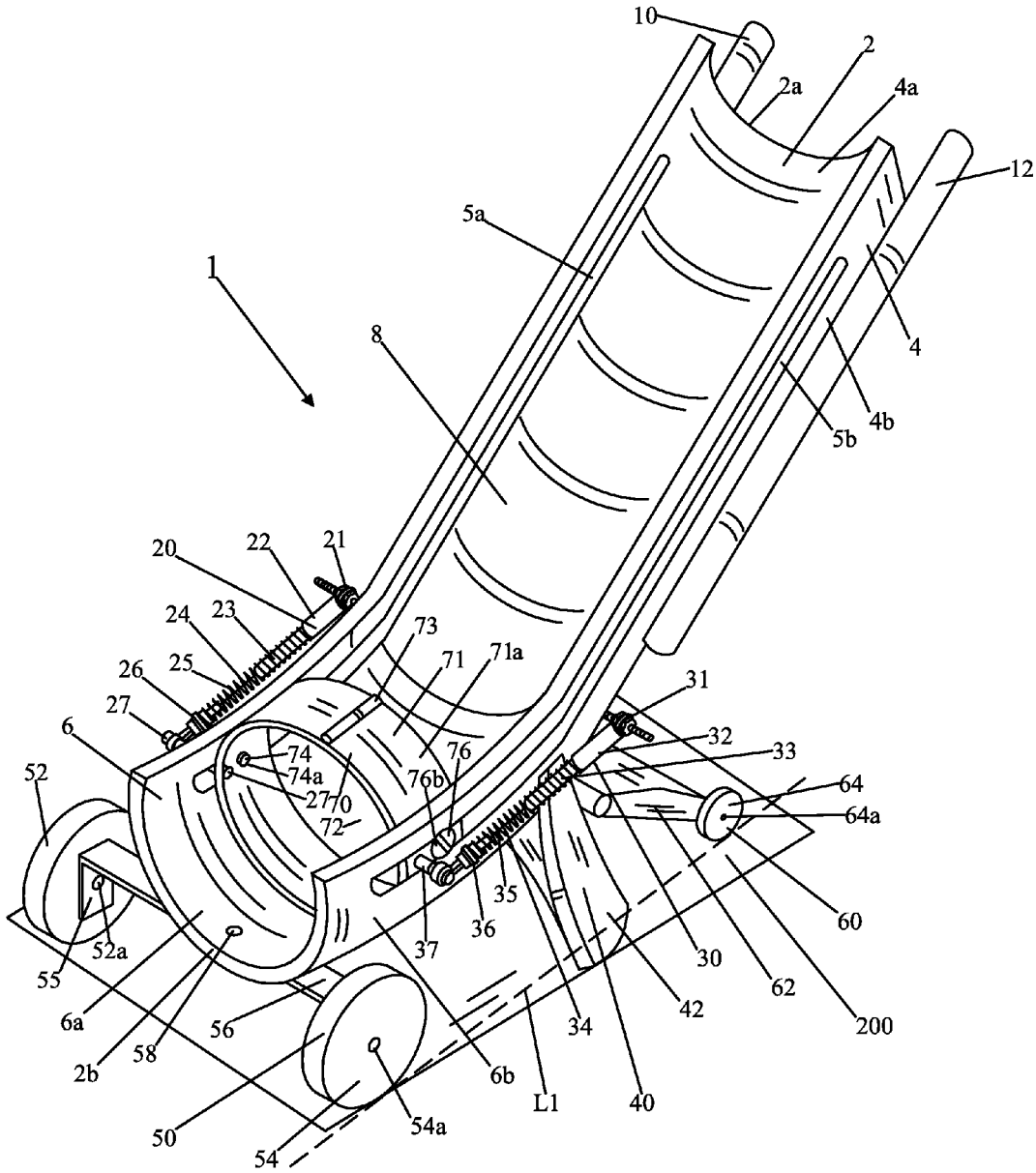
FIG. 1A shows a front, top, right perspective view of an apparatus in accordance with an embodiment of the present invention, with the apparatus in a first state and placed on a floor or ground surface.
Figure 1B:
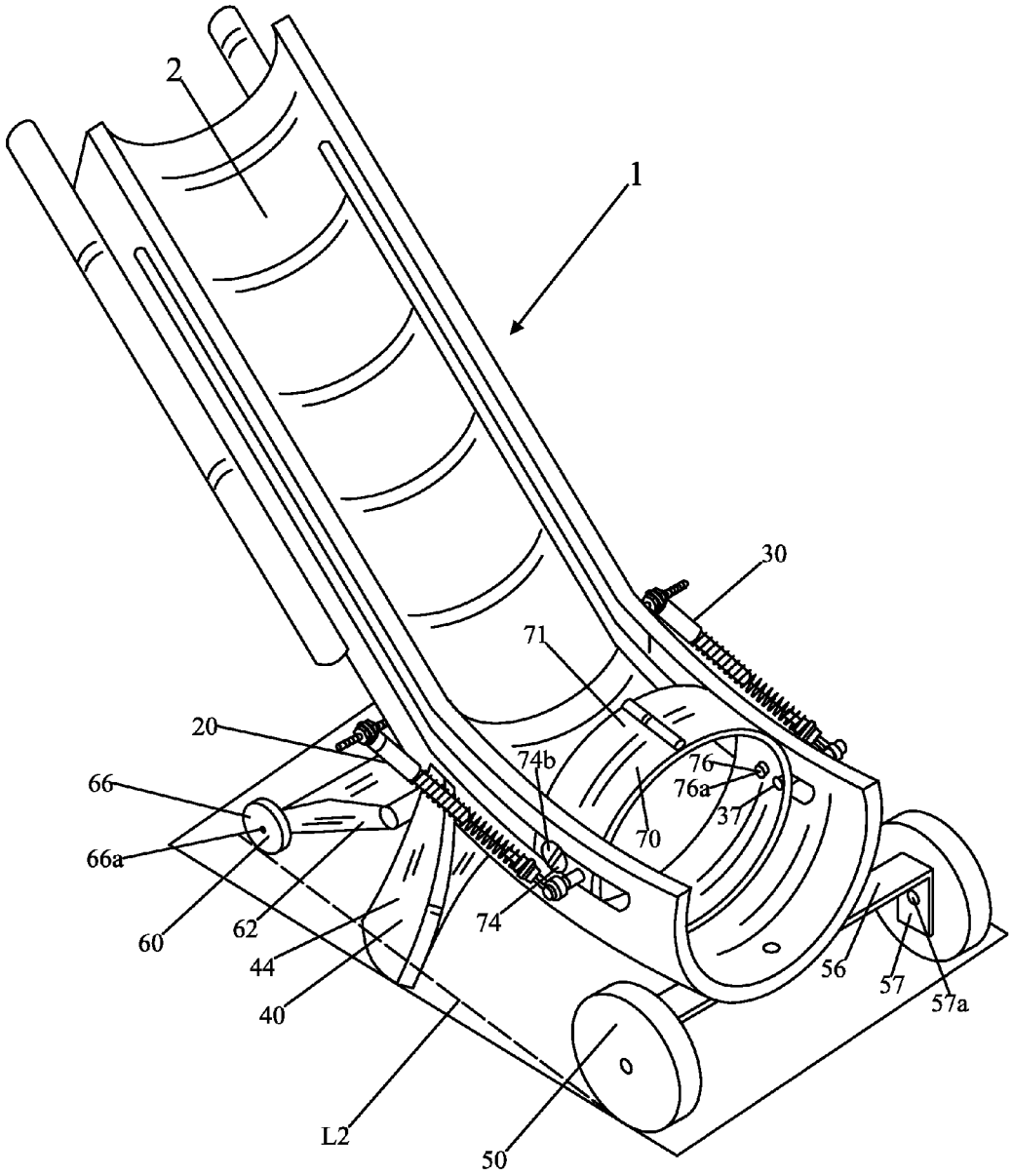
FIG. 1B shows a front, top, left perspective view of the apparatus of FIG. 1A, with the apparatus of FIG. 1A in the first state.
Figure 2A:
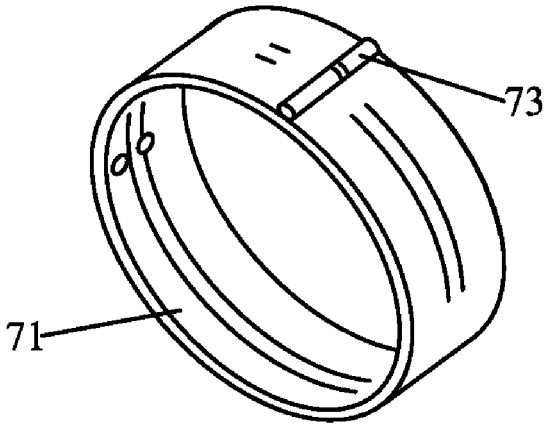
FIG. 2A shows a front, top, right perspective view of a first hollow tube which is part of the apparatus of FIG. 1A.
Figure 2B:
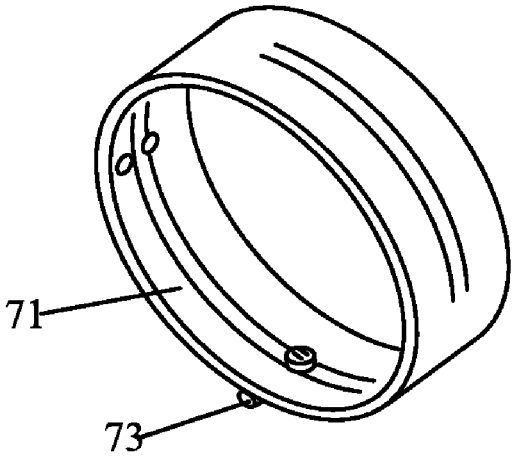
FIG. 2B shows a rear, bottom, left perspective view of the first hollow tube of FIG. 2A.
Figure 9A:
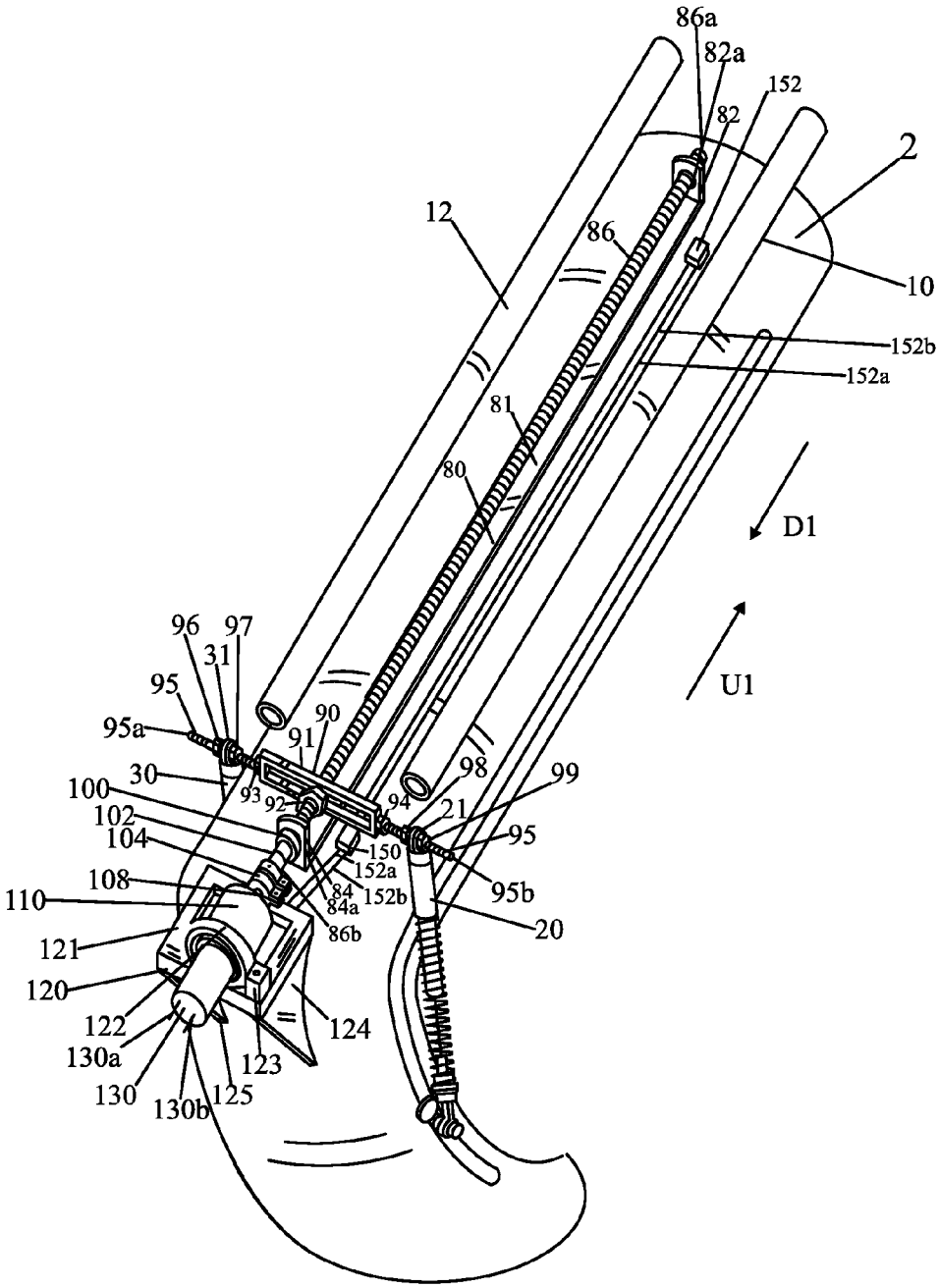
FIG. 9A shows rear, bottom, and left side perspective view of a portion of the apparatus of FIG. 1A.
Figure 9B:
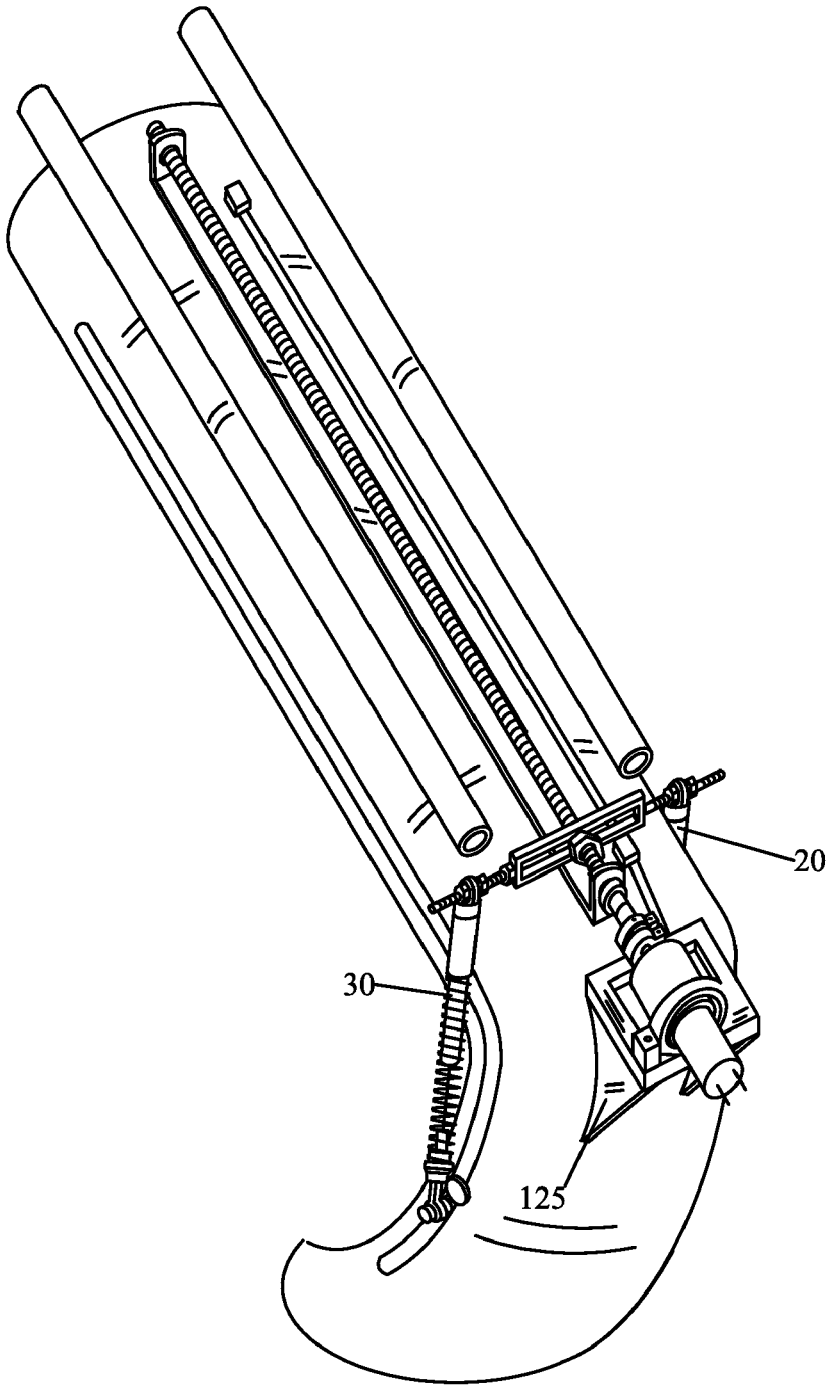
FIG. 9B shows a rear, bottom, and right side perspective view of the portion of the apparatus of FIG. 1A shown in FIG. 9A.
Figure 10A:
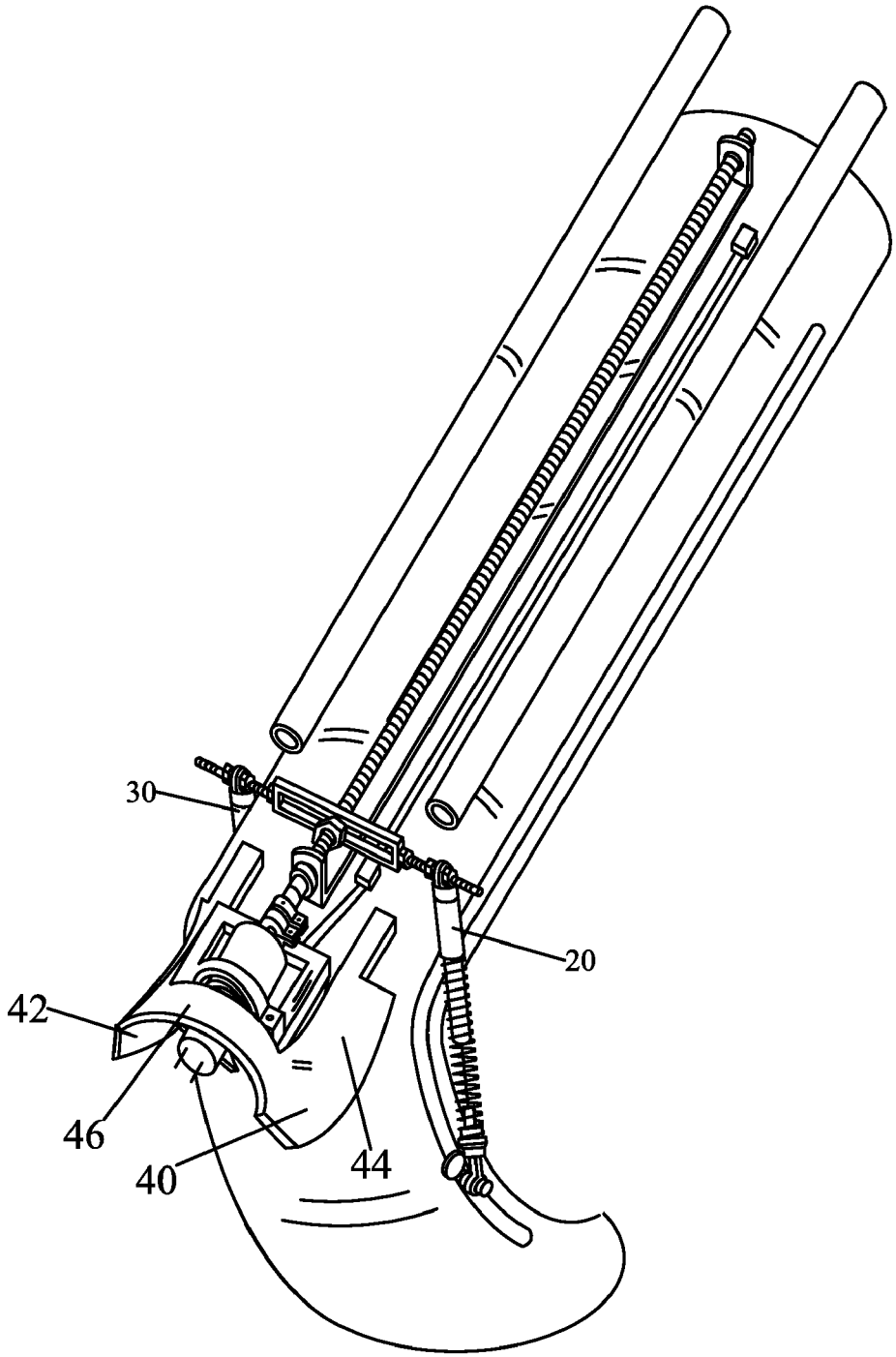
FIG. 10A shows rear, bottom, and left side perspective view of a portion of the apparatus of FIG. 1A.
Figure 10B:
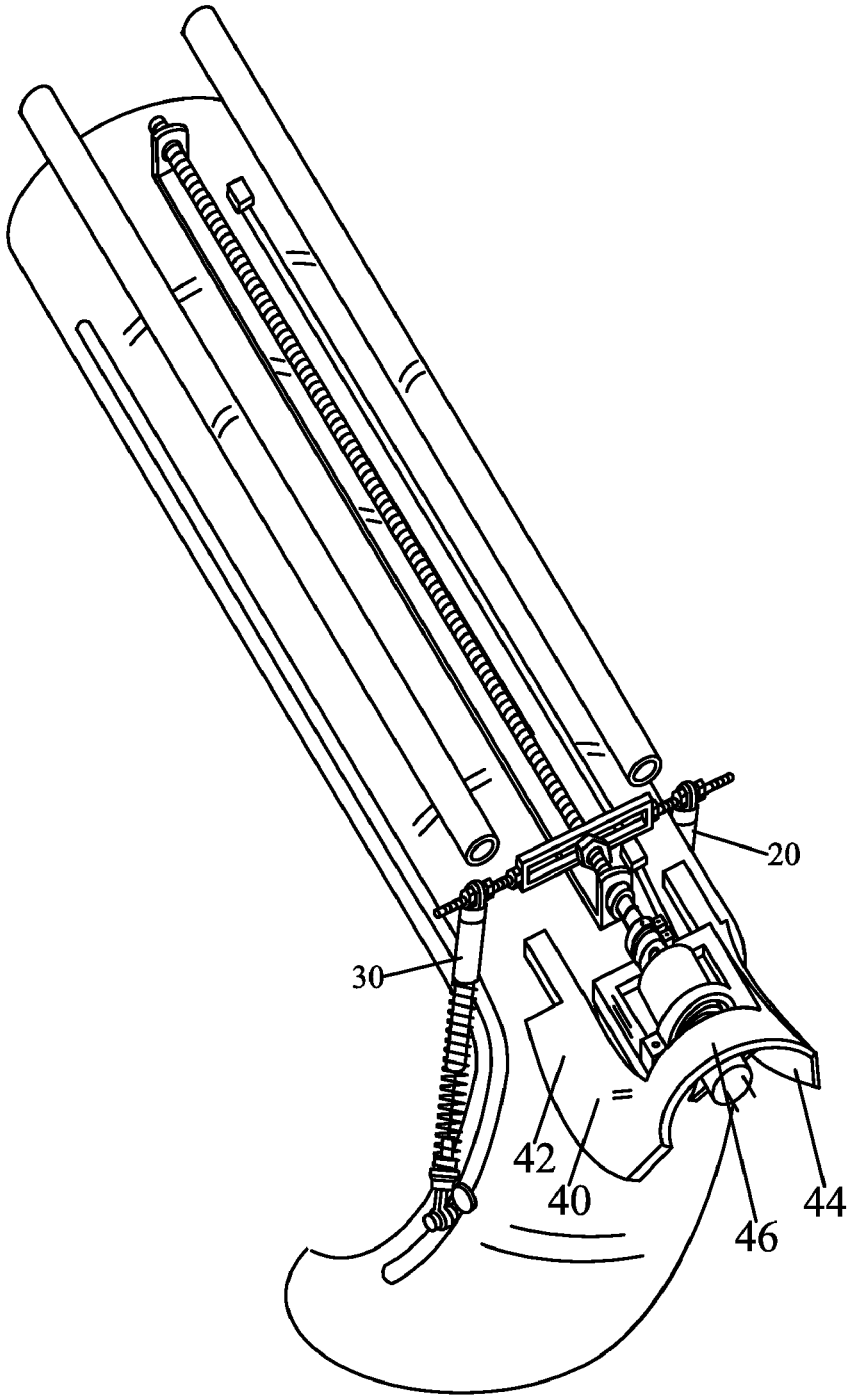
FIG. 10B shows a rear, bottom, and right side perspective view of the portion of the apparatus of FIG. 1A shown in FIG. 10A.
Figure 11A:
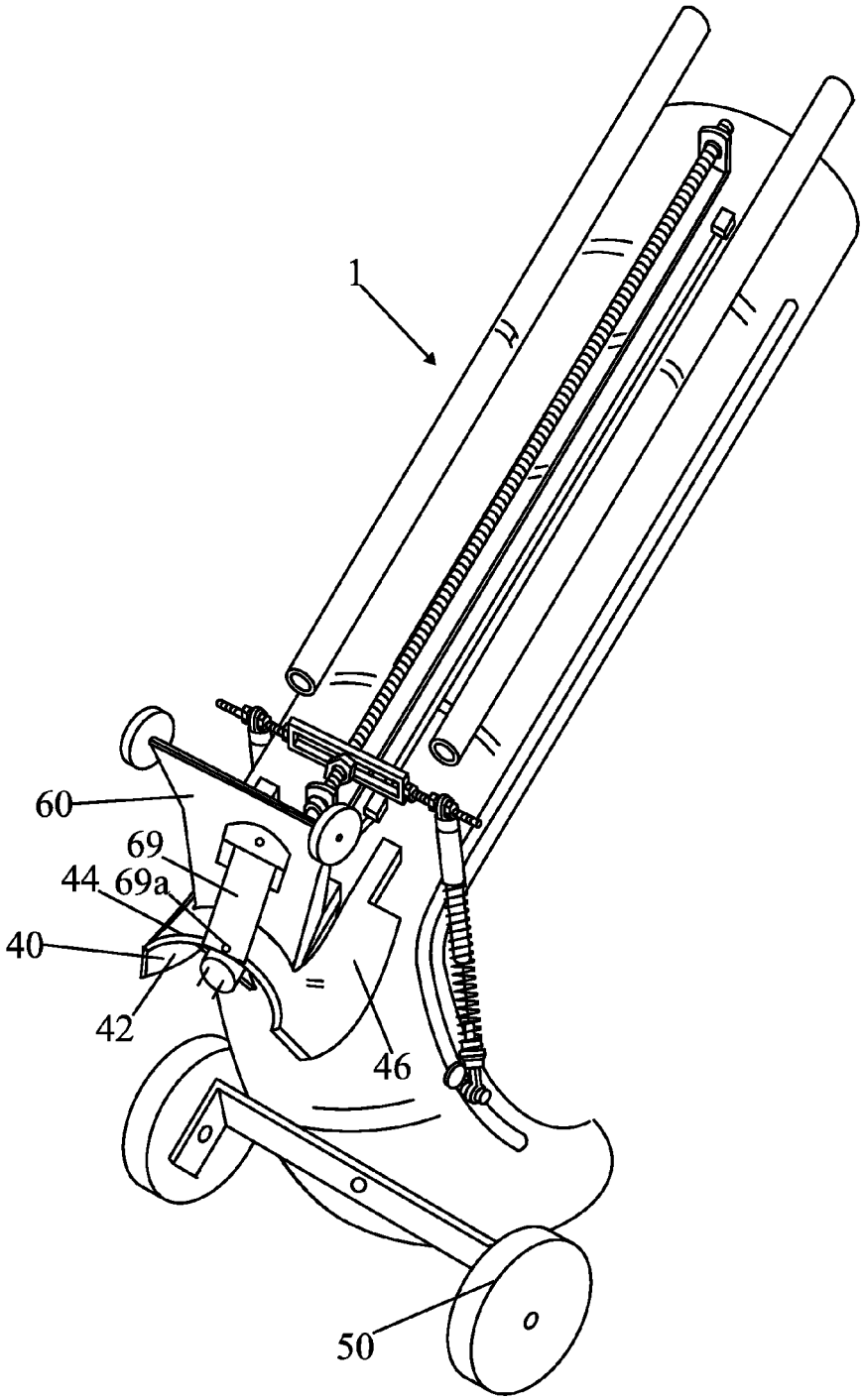
FIG. 11A shows rear, bottom, and left side perspective view of the apparatus of FIG. 1A, with the apparatus of FIG. 1A, in the first state.
Figure 11B:
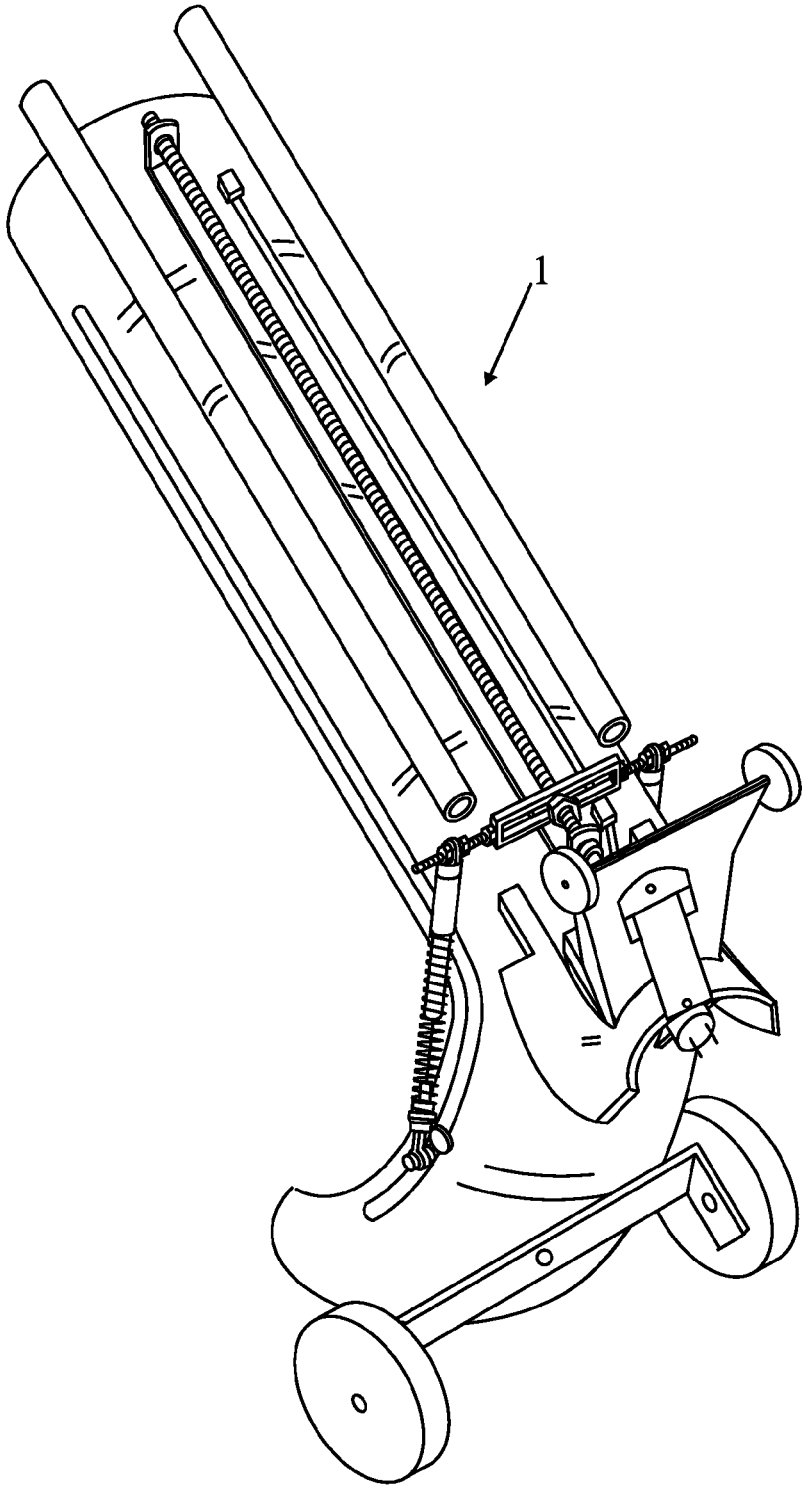
FIG. 11B shows a rear, bottom, and right side perspective view of the apparatus of FIG. 1A shown in FIG. 11A, with the apparatus of FIG. 1A in the first state.

FIG. 1A shows a front, top, right perspective view of an apparatus 1 in accordance with an embodiment of the present invention, with the apparatus 1 in a first state and placed on a floor or ground surface 200. FIG. 1B shows a front, top, left perspective view of the apparatus 1, in the first state. FIG. 9A shows rear, bottom, and left side perspective view of a portion of the apparatus 1. FIG. 9B shows a rear, bottom, and right side perspective view of the portion of the apparatus 1 shown in FIG. 9A. FIG. 10A shows rear, bottom, and left side perspective view of a portion of the apparatus 1. FIG. 10B shows a rear, bottom, and right side perspective view of the portion of the apparatus 1 shown in FIG. 10A. FIG. 11A shows rear, bottom, and left side perspective view of the apparatus 1, with the apparatus 1, in the first state. FIG. 11B shows a rear, bottom, and right side perspective view of the apparatus 1, with the apparatus 1 in the first state.

Referring to FIGS. 1A and 1B, the apparatus 1 includes a section 2, a device 20, a device 30, a device 40, a wheel device 50, a wheel device 60, and a tube device 70. Referring to FIGS. 9A-9B, which show a portion of the apparatus 1, the apparatus 1 also includes device 80, device 90, devices 100, 102, 104, motor 110, and power device 130.

Figure 8:
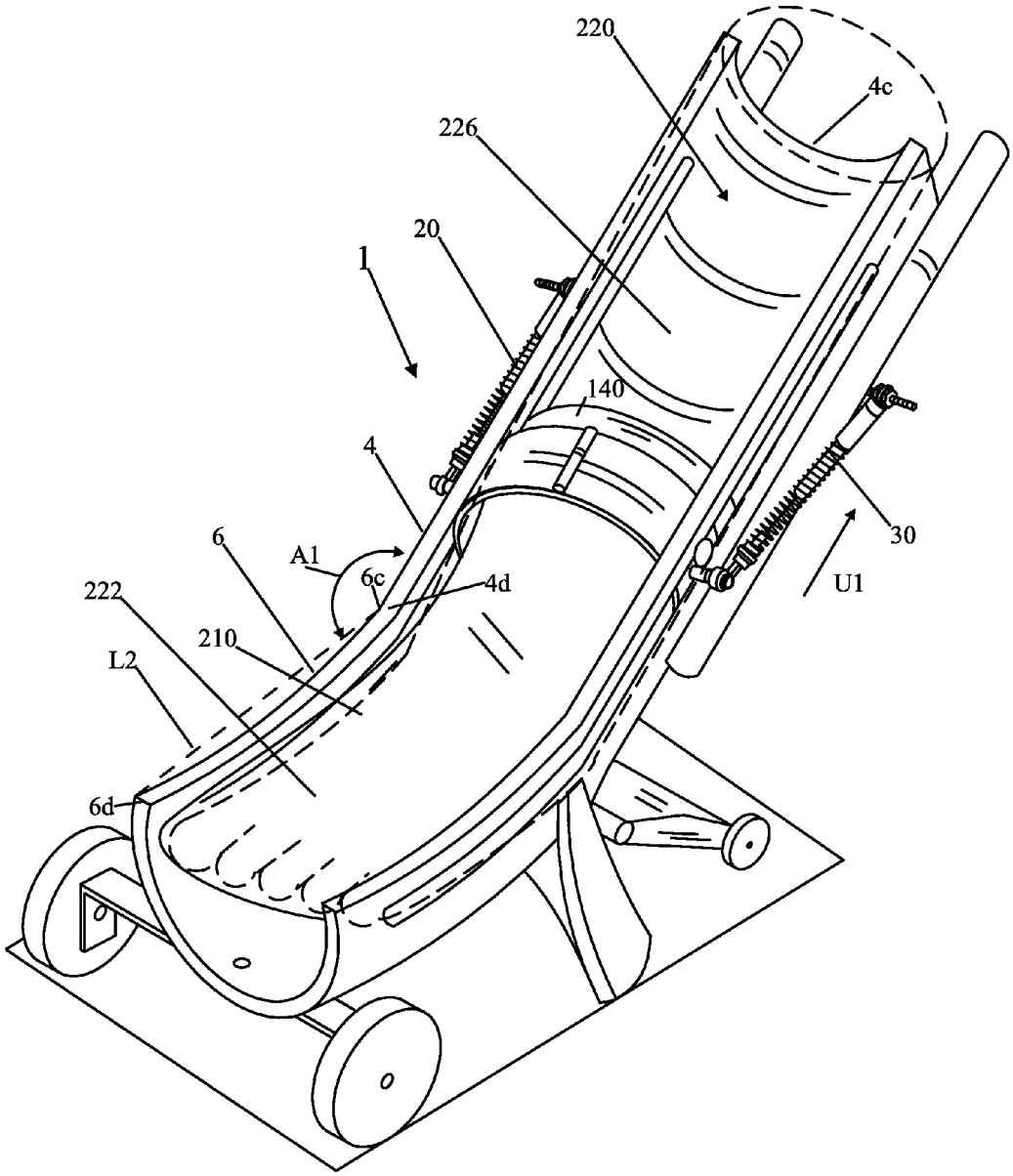
FIG. 8 shows a front, top, right side perspective view of the apparatus of FIG. 1A, in a second state, with the second hollow tube and the sock as shown in FIG. 4A inserted into the first hollow tube of the apparatus of FIG. 1A, and with the first hollow tube moved into a different position from FIG. 7 to cause the sock to be tightly fit onto the person's foot.

The section 2, may be comprised of subsection 4 and subsection 6. Subsection 4 may be substantially a PVC (polyvinylchloride) cylindrical hollow pipe which has been cut in half leaving a substantially semicircular shaped inner surface 4*a*. Subsection 4 has inner surface 4*a* and a substantially semicircular shaped outer surface 4*b*. The subsection 6 may be a curved PVC hollow pipe which has been cut in half. The subsection 6 may have an inner surface 6*a* and an outer surface 6*b*. The subsections 4 and 6 are joined together, as shown in FIGS. 1A and 1B, to form a continuous channel 8. The subsection 4 may be substantially straight from the end 4*c* to an end 4*d* which joins with an end 6*c* of the subsection 6 as shown in FIG. 8. The subsections 4 and 6 may be fixed at an end 6*c* of the subsection 6 (to the end 4*d*), shown in FIG. 8. The subsections 4 and 6 may be fixed so that a line L2, shown at in FIG. 8, is at an angle A1 with respect to the subsection 4, wherein the line L2 goes from the end 6*c* to an opposing end 6*d* of the subsection 6. The subsection 6 curves from end 6*c* to the end 6*d*. The angle A1 may be between ninety and one hundred and eighty degrees, such as about one hundred and thirty-five degrees. The curving of the subsection 6 and the angle A1 are used to match the curving of the leg 220 from the ankle portion 226 to the foot 222 as shown in FIG. 8 to provide a comfortable positioning of the leg 220, the foot 222, and the ankle portion 226 for putting on and taking off of the sock 210.

There are slots 5*a* and 5*b* which are cut into portions of the sides of the subsections 4 and 6 and which run continuously from the subsection 4 to the subsection 6. The section 2 may have a top end 2*a* and a bottom end 2*b*.

The apparatus 1 includes hollow cylindrical tubes 10 and 12 which are fixed, such as by adhesive to the back of section 2, as shown in FIGS. 1A and 9A. The tubes 10 and 12 can be used for inserting wires such as wires 520 and 522 shown in FIG. 18, and for connecting a handle and/or control device 500 shown in FIG. 18.

The device 20 includes a connector 21, a member 22, a member 23, a spring 24, a pin 25, a device 26, and a pin device 27. The device 30 may be identical to the device 20 and may include a connector 31, a member 32, a member 33, a spring 34, a pin 35, a device 36, and pin device 37.

The device 40 includes a portion 42, a portion 44, and a portion 46 which connects the portions 42 and 44 as shown by FIGS. 10A and 10B. The portions 42 and 44 are fixed to the back of the section 2. The device 40 may be made of PVC or another hard plastic material.

The wheel device 50 includes wheels 52 and 54, horizontal member 56, and vertical members 55 (shown in FIG. 1A) and 57 (shown in FIG. 1B). The member 56 is rotatably or pivotally fixed to the section 2 by a pivot pin or pivot device 58 shown in FIG. 1A, so that the member 56 can swivel or rotated about 58 with respect to the section 2. The wheels 52 and 54 are pivotally or rotatably fixed to the members 55 and 57, by pin or pin devices 52*a* and 54*a*, respectively, referring to FIGS. 1A and 1B.

The wheel device 60 includes wheels 64 and 66 which are pivotally mounted to device 62. The wheel device 60 may fixed, to the device 40 so that the wheel device 60 does not move or rotate by a member 69 and a fastener 69*a* shown in FIG. 11A, and/or by being adhered to the device 40 and/or the section 2.

Figure 15:
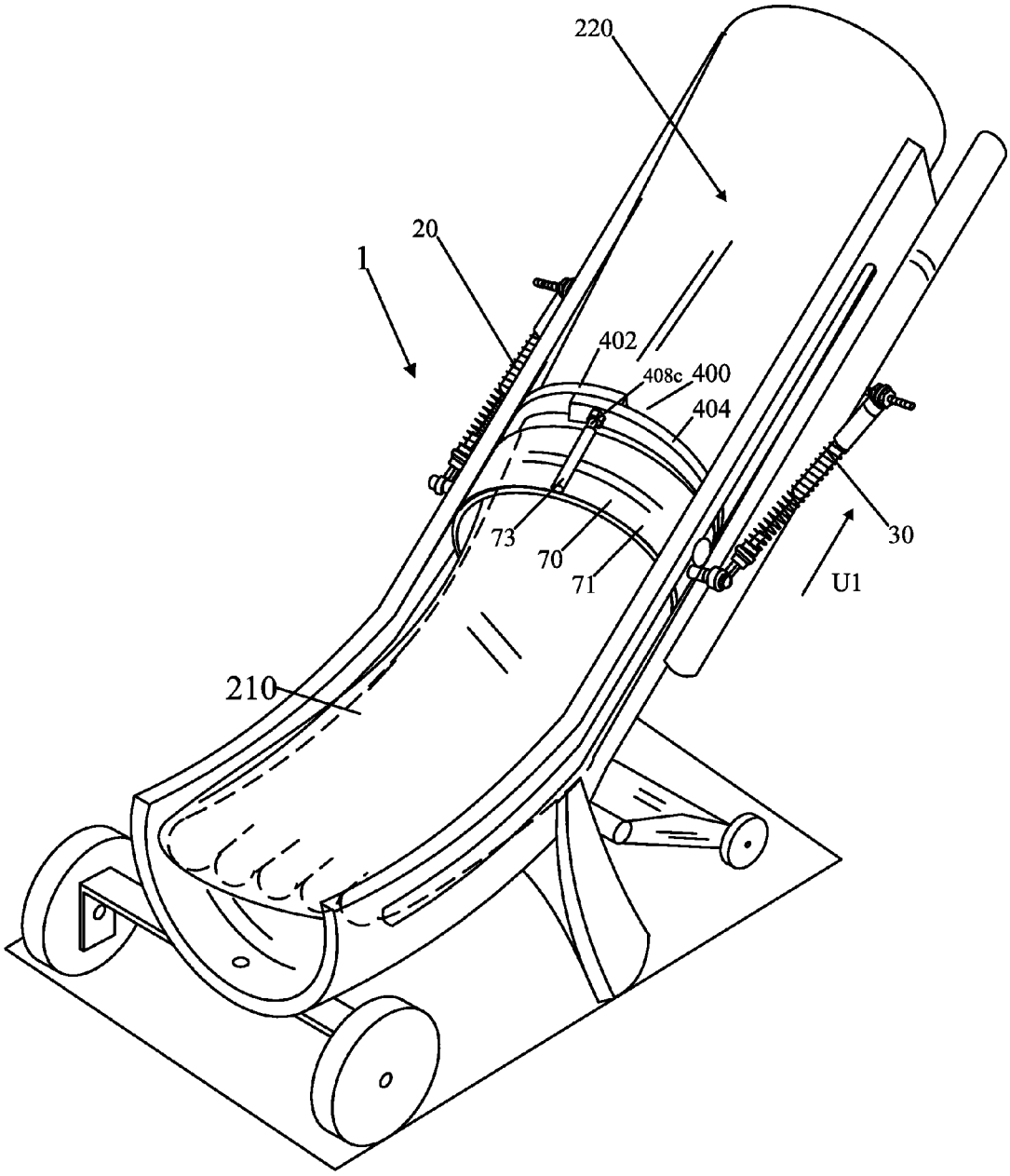
FIG. 15 shows a front, top, right perspective view of the apparatus of FIG. 1A in the second state, placed on the floor or the ground surface, with the foot having a sock on it placed through the first hollow tube, with the clamping device attached to an ankle portion or a leg portion of a person, and with the first hollow tube attached to the clamping device.
Figure 16:
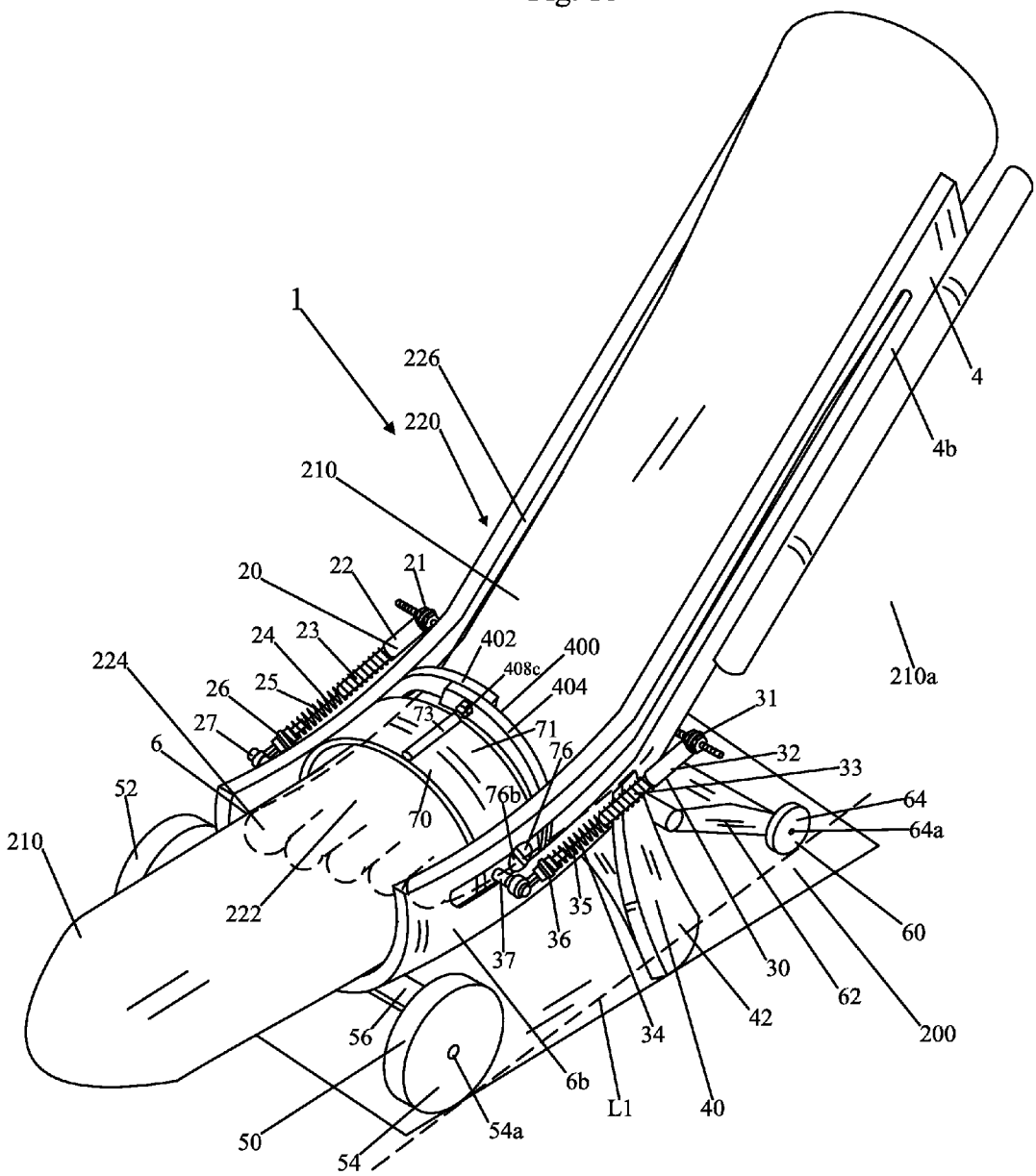
FIG. 16 shows a front, top, right perspective view of the apparatus of FIG. 1A in the first state, placed on the floor or the ground surface, with the foot placed through the first hollow tube, with the clamping device having slid down a leg portion of a person, with the first hollow tube attached to the clamping device, and with the sock having been taken off of the foot.

The tube device 70 may include a hollow tube 71 shown in FIGS. 1A, 1B, 2A and 2B. The tube device 70 may also include a pin device 74 and a pin device 76 which include pins 74*a* and 76*a* inserted into slots 5*a* and 5*b*, respectively, and inserted through the sides of and fixed to the hollow tube 71. The pin devices 74 and 76 also include caps 74*b* and 76*b* which keep the pins 74*a* and 74*b* from falling out of the slots 5*a* and 5*b* and thus keep the tube 71 from falling out of the slots 5*a* and 5*b*. The pins or pin devices 27 and 37 also are fixed to the tube 71 as shown by FIGS. 1A and 1B. The tube device 70 may further include a tube 73 fixed to the periphery or outer surface 71*a* of the tube 71, as shown in FIG. 1A. As shown by FIGS. 15 and 16, the pin 408*c* may be inserted into the tube 73 and thereby temporarily attached to the tube 73 to pull down and/or help take off a sock, such as the sock 210.

The device 80 shown in FIG. 9A may include a plate 81 and members 82 and 84 which may be substantially perpendicular or perpendicular to the plate 81. The plate 81 is fixed to the back of the section 2, such as by adhesive. The plate 81 and members 82 and 84 may be made of metal or a hard plastic. Members 82 and 84 have openings 82*a* and 84*a*, respectively, into which a threaded bar or rod 86 has been inserted. The bar or rod 86 has been inserted such that a portion of the rod 86 lies within the opening 84*a*, a portion of the rod 86 lies within the opening 86*b*, a first end 86*a* of the rod 86 lies near the opening 82*a*, and a second end 86*b* of the rod 86 lies near the opening 84*a*.

The device 90 shown in FIG. 9A connects the threaded rod 86 to the devices 20 and 30, so that the turning of the threaded rod 86 causes the device 90 to move upwards in the direction U1 shown or downwards in the direction D1 shown in FIG. 9A. The device 90 includes a rectangular member 91 which may be made of metal, and a bolt 92, which may be made of metal, which is fixed to the member 91 or molded or integral with the member 91. The member 91 is also fixed to bolts 93 and 94. A threaded rod 95 is inserted into the connectors 31 and 21 so that a portion of the threaded rod 95 lies within an opening of the connector 31, an end 95*a* lies near the connector 31, a portion of the threaded rod 95 lies within an opening of the connector 21, and an end 95*b* lies near the connector 21. The device 90 also includes bolts 96 and 97 for holding the connector 31 in place on the threaded rod 95 and bolts 98 and 99 for holding the connector 21 in place on the threaded rod 95 as shown in FIG. 9A.

The devices 100 and 102 may be spacers for properly aligning the rod 86 with the motor 110. The devices 104 may be clamps and/or spacers for clamping the end 86*b* of the rod 86 to a shaft 108 of the motor 110 shown in FIG. 9A. The motor 110 may be clamped or fixed to the back of the section 2 by housing or device 120, and housings 145 and 125. The device 120 includes a rectangular portion 121, a strap portion 122, and a pin or screw device 123 for tightening the motor 110 and holding it to the section 2. The motor 110 may be held to the section 2 by any known means such as adhesive.

The power device 130 may include power terminals 130*a* and 130*b*.

Figure 3A:
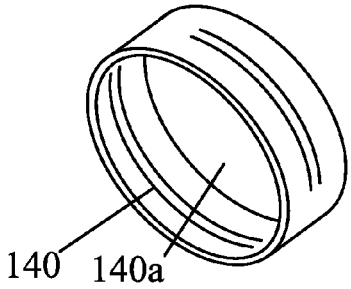
FIG. 3A shows a front, top, right perspective view of a second hollow tube which can be used with the apparatus of FIG. 1A.
Figure 3B:
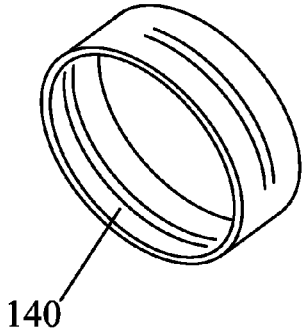
FIG. 3B shows a rear, bottom, left perspective view of the second hollow tube of FIG. 3A.

FIG. 3A shows a front, top, right perspective view of a second hollow tube 140 which can be used with the apparatus 1. FIG. 3B shows a rear, bottom, left perspective view of the second hollow tube 140.

Figure 4A:
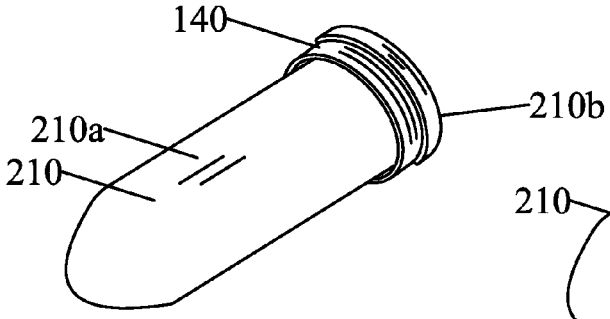
FIG. 4A shows a front, top, right perspective view of a sock, with a portion of the sock inserted into the second hollow tube of FIG. 3A and with a fringe or edge top portion of the sock overlapped over a peripheral body portion of the second hollow tube, so that toes and a foot of a person can be inserted through an opening of the second hollow tube, and into an inner chamber of the sock.
Figure 4B:
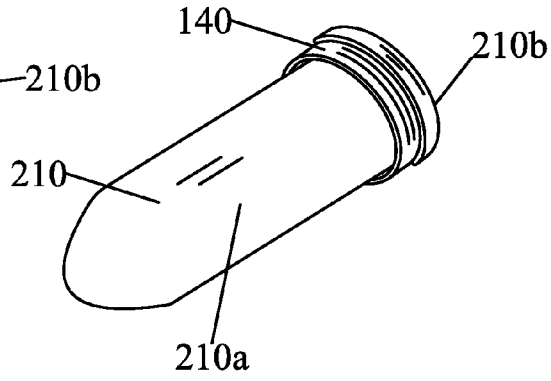
FIG. 4B shows a rear, bottom, left perspective view of the sock of FIG. 4A, with the portion of the sock inserted into the second hollow tube and with the fringe or edge top portion of the sock overlapped over the peripheral body portion of the second hollow tube, as in FIG. 4A.

FIG. 4A shows a front, top, right perspective view of a sock 210, with a portion 210*a* of the sock inserted through second hollow tube 140, and with a fringe or edge top portion 210*b* of the sock overlapped over a peripheral body portion of the second hollow tube 140, so that toes and a foot of a person can be inserted through an opening 140*a* of the second hollow tube 140, and into an inner chamber of the sock. FIG. 4B shows a rear, bottom, left perspective view of the sock 210 of FIG. 4A, with the portion of the sock 210*a* inserted into the second hollow tube 140 and with the fringe or edge top portion 210*b* of the sock 210 overlapped over the peripheral body portion of the second hollow tube 140, as in FIG. 4A.

Figure 5:
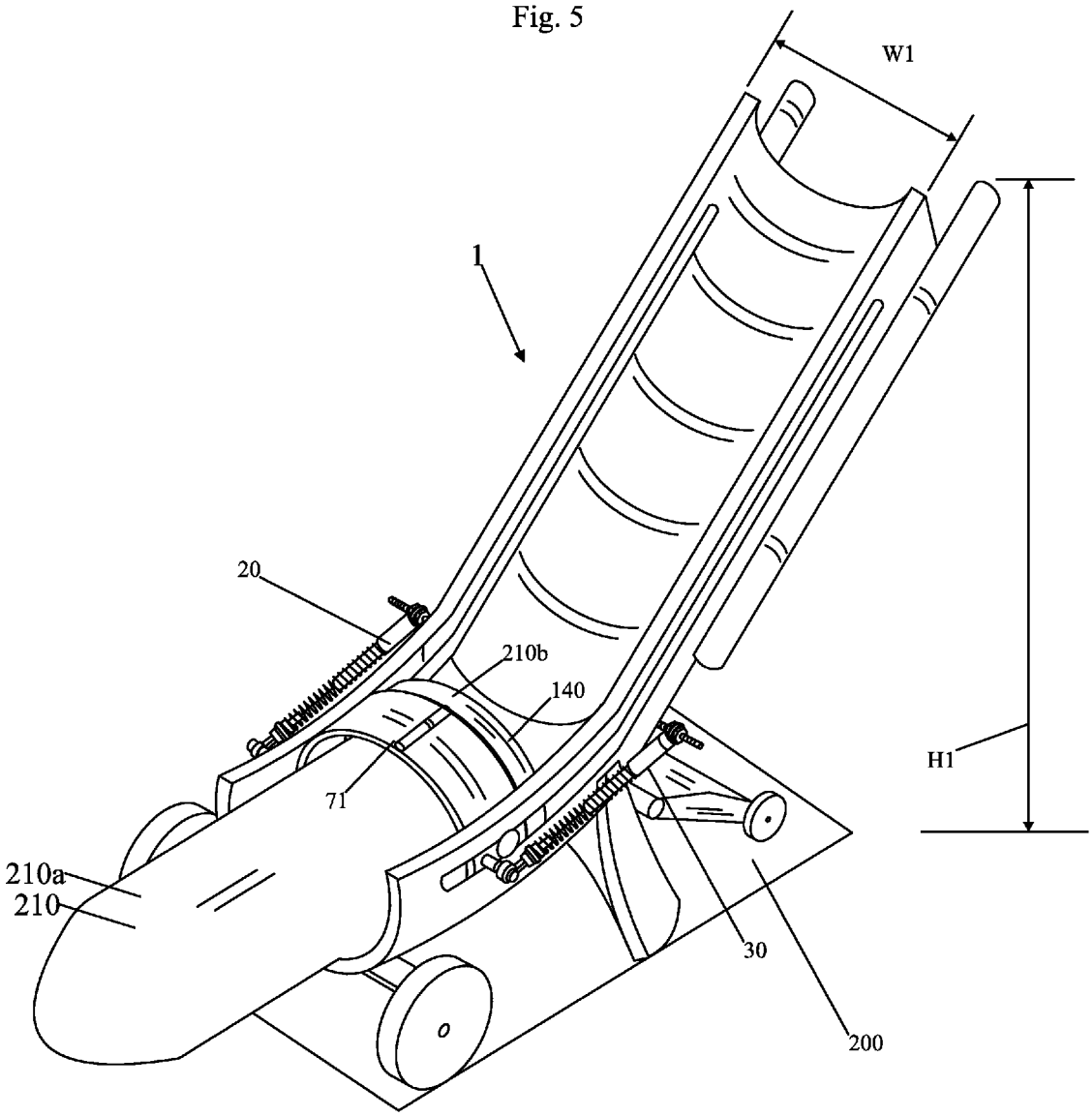
FIG. 5 shows a front, top, right perspective view of the apparatus of FIG. 1A, in the first state, with the second hollow tube and the sock as shown in FIG. 4A inserted into the first hollow tube of the apparatus of FIG. 1A.

FIG. 5 shows a front, top, right perspective view of the apparatus 1, in the first state, with the second hollow tube 140 and the sock 210 as shown in FIG. 4A inserted into the first hollow tube 71 of the apparatus 1. In at least one embodiment, the pins 74*a* and 76*a* shown in FIG. 1A and FIG. 1B, prevent the tube 140 from going all the way through the tube 71. Thus in FIG. 5, the tube 140 fits snugly within the tube 71 so that the tube 140 is halfway into the tube 71 but does not go through the tube 71, and the tube 140 is held within the tube 71. The tube 140 has an outer diameter which is slightly smaller than the inner diameter of the tube 71 to provide for a snug fit.

Figure 6:
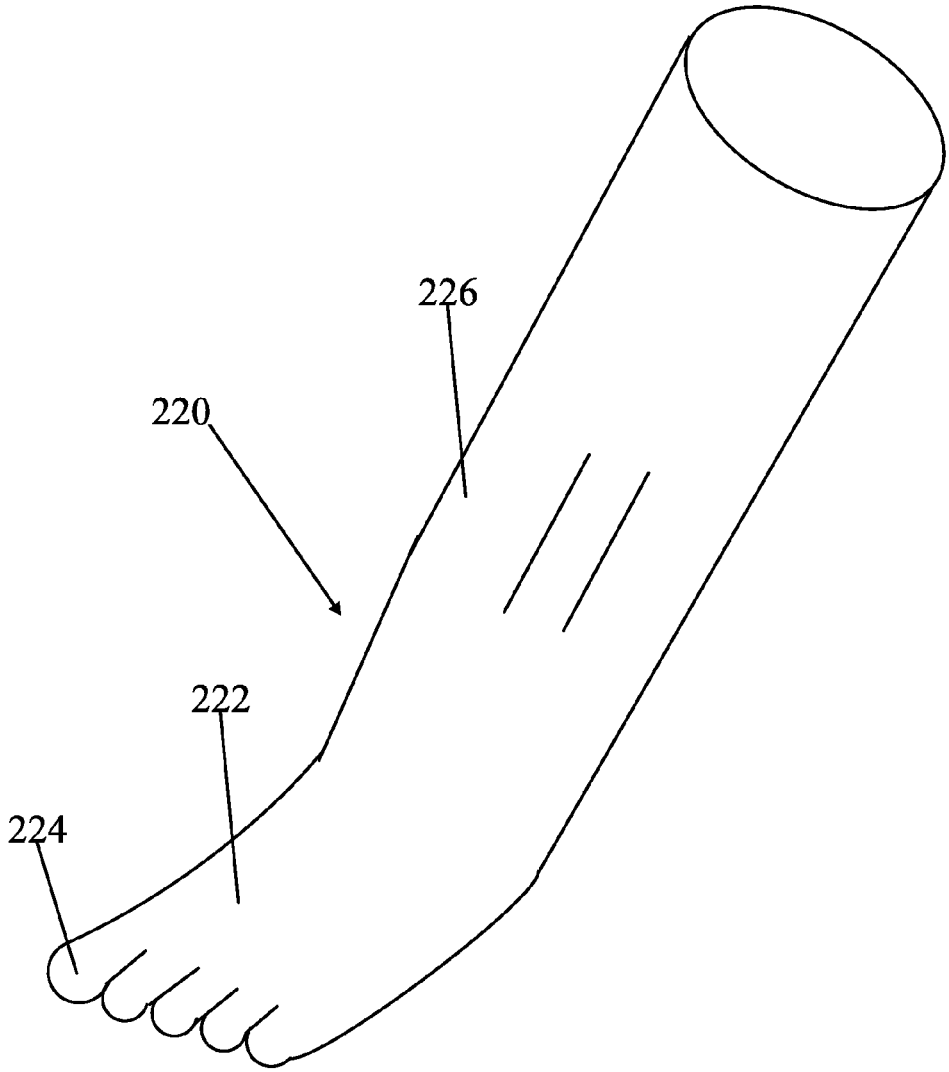
FIG. 6 shows a front, top, right side perspective view of a foot and an ankle of a person.

FIG. 6 shows a front, top, right side perspective view of a portion 220 of a leg of a person, including a foot 222, toes 224, and an ankle 226.

Figure 7:
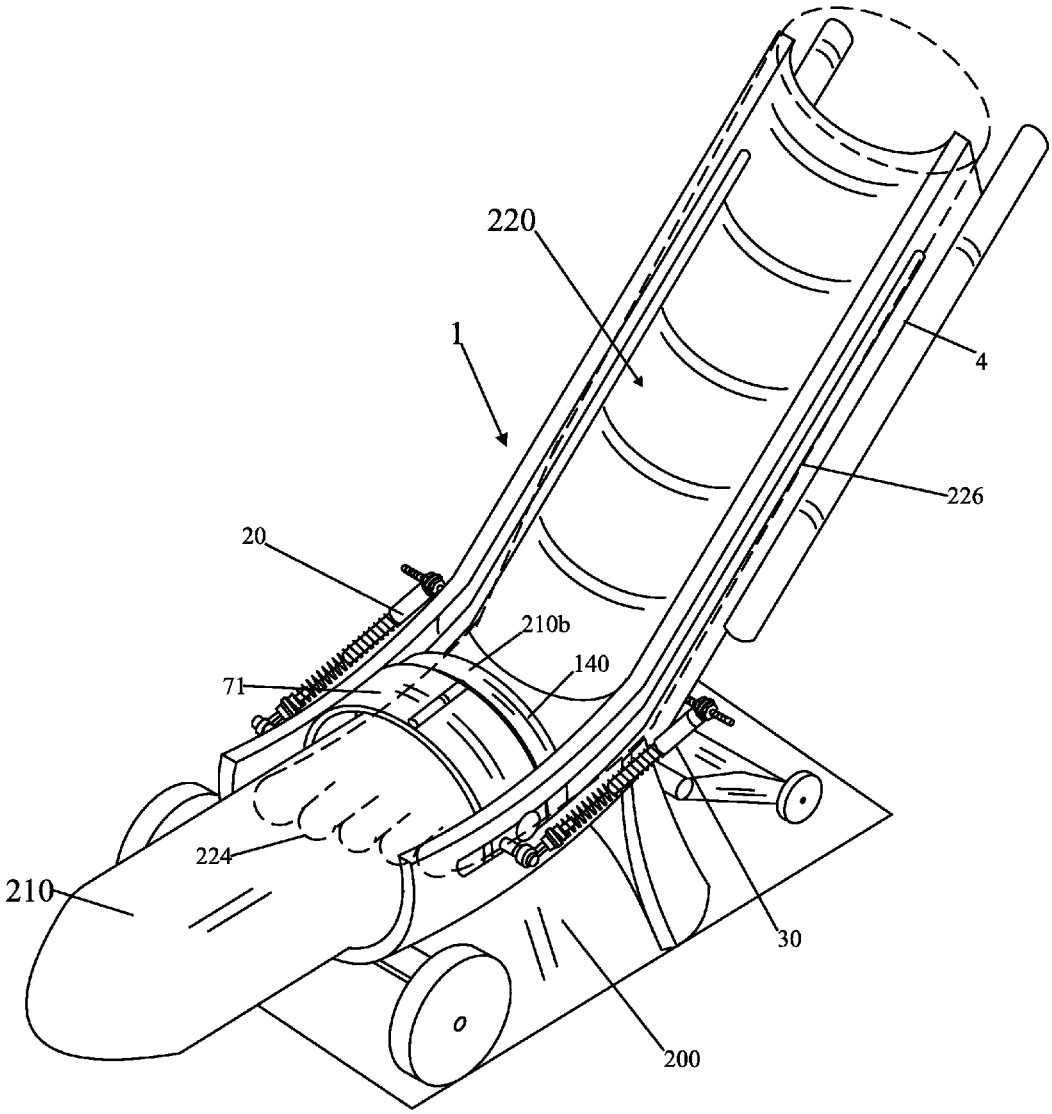
FIG. 7 shows a front, top, right side perspective view of the apparatus of FIG. 1A, in the first state, with the second hollow tube and the sock as shown in FIG. 4A inserted into the first hollow tube of the apparatus of FIG. 1A, with a portion of the person's foot of FIG. 6 inserted into the sock and with the ankle of the person resting on a portion of the apparatus of FIG. 1A.

FIG. 7 shows a front, top, right side perspective view of the apparatus 1 of FIG. 1A, in the first state, with the second hollow tube 140 and the sock 210 as shown in FIG. 4A inserted into the first hollow tube 71 of the apparatus 1, with a portion of the person's leg 220 of FIG. 6 inserted into the sock 210, so that the toes 224, shown by dashed lines are within an inner chamber of the sock 210, and with the ankle 226 resting on the inner surface 4*a* of the subsection 4 of the apparatus 1. The portion 220 of the leg of a person shown in FIG. 7 is substantially or entirely within the channel 8 of the section 2.

FIG. 8 shows a front, top, right side perspective view of the apparatus 1, in a second state, with the second hollow tube 140 and the sock 210 as shown in FIG. 4A inserted into the first hollow tube 71 of the apparatus 1, and with the first hollow tube 71 moved into a different position from FIG. 7 to cause the sock 210 to be tightly fit onto the portion 220 of the person's leg. The devices 20 and 30 have pulled the tube 71 up in the direction U1 from the first state shown in FIG. 7 to the second state shown in FIG. 8. When the tube 71 is pulled up in the direction U1 by the devices 20 and 30, the tube 140 also moves up causing the sock 210 to be fitted onto the person's foot 222 and at least a portion of the person's ankle 226.

In order to move the tube 71 (and thus the inserted tube 140) in the direction U1, the threaded rod 86 is rotated in, for example, a clockwise direction, and this causes the device 90 to move in the direction U1 as a result of the interaction of the inner threads of bolt 92 and the rotating threaded bar or rod 86. When the bolt 92, and thus the member 91 and the device 90 move up in the direction U1, this causes the devices 20 and 30 to be pulled up in the direction U1 by connectors 21 and 31 which are connected to the device 90 through threaded bar 95.

The rotation of the threaded bar 86 is caused by the rotation of the motor shaft 108 of the motor 110, which is clamped and/or otherwise fixed to the threaded bar 86 so that when the motor shaft 108 turns the threaded bar 86 turns.

Figure 12:
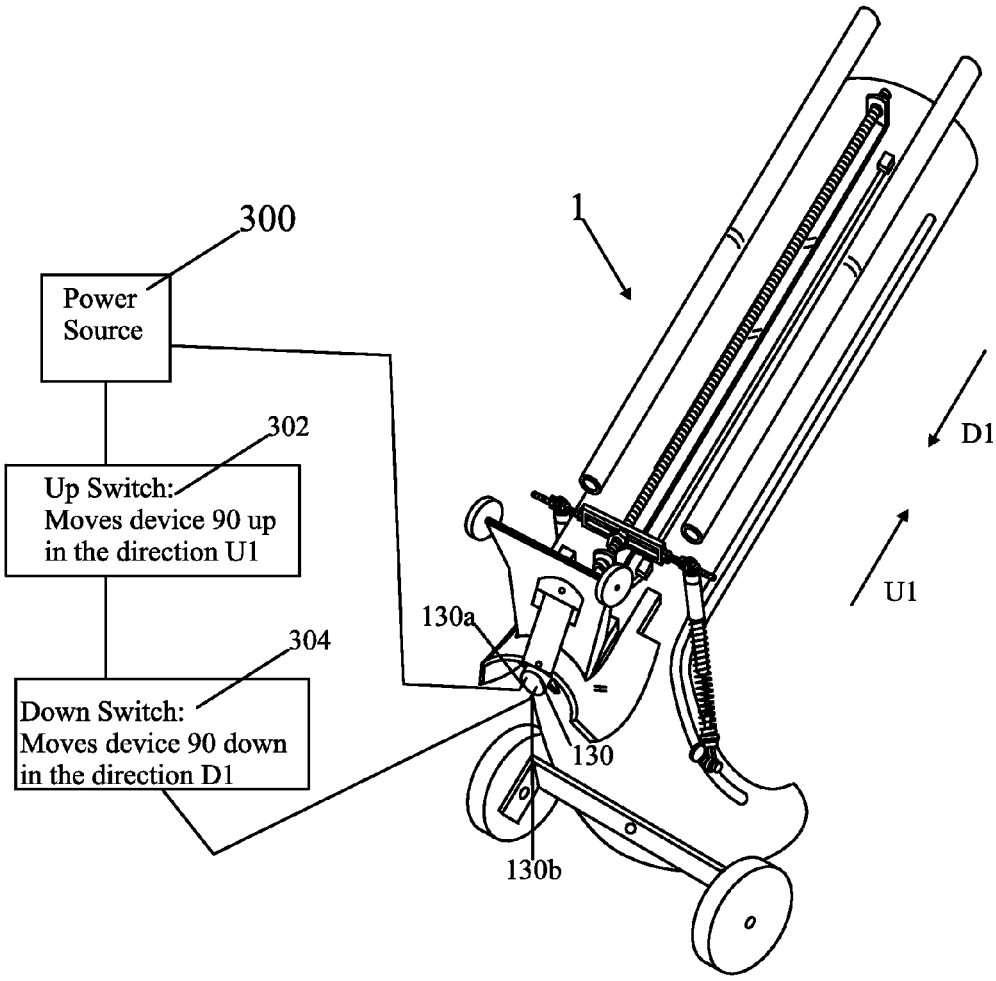
FIG. 12 shows rear, bottom, and left side perspective view of the apparatus of FIG. 1A, with the apparatus of FIG. 1A, in the first state, and a block diagram of various components for controlling the apparatus of FIG. 1A.

A shown by FIG. 12, the terminals 130*a* and 130 of the power device 130 are in an electrical circuit with a power source 300, an up/down toggle switch (red switch) 302, and an on/off switch 304 (black switch). The components 300, 302, and 304 are shown in block diagram format and various known components may be provided for 300, 302, and 304.

In operation an individual may press the switch 302 (red switch) together with the black switch 304 to cause the device 90 to go up in the direction U1 shown in FIG. 9A to cause the sock 210 to be fitted onto a portion of a person's leg, such as 220, such as shown and described by the transition from FIG. 7 to FIG. 8. Letting go of the switch 302 and pressing 302 again, together with 304 may cause the device 90 to go down in the direction D1 shown in FIG. 9A to cause the sock 210 to be taken off of a portion of a person's leg, such as 220. I.e. to take a person's sock off, the transition would be from the FIG. 8 state to the FIG. 7 state. A single toggle switch can be used instead of switches 302 and 304, and when it is first pressed the device 90 would move up in the direction U1, in response to, for example, the bar 86 rotating clockwise, and when it is let go the bar 86 would stop turning, and then when the single switch is pressed again, the device 90 would move downwards in the direction D1, as a result of the bar 86 rotating in an opposite direction, such as counter clockwise. The single switch may be effectively change the polarity of current applied to the motor 110 or otherwise cause the motor 110 to toggle from clockwise rotation to counter clockwise rotation and back again.

The device 40 shown in FIGS. 1A, 1B, and 10A and 10B may be used to prevent the apparatus 1 from rolling, and/or moving, while an individual is putting a sock on or taking a sock off. The portions 42 and 44 as shown by FIGS. 1A and 1B extends beyond a line L1 and a line L2, respectively, so that the wheels 54 and 64 and the wheels 52 and 66, respectively, cannot rest on the surface 200 at the same time. Thus the apparatus 1 can be tilted backwards onto wheels 64 and 66 to roll apparatus 1, or tilted forward onto wheels 52 and 54 roll the apparatus 1, but when the apparatus 1 is situated as in FIG. 1A and FIG. 1B, the apparatus 1 does not roll or move or does not roll or move substantially.

Figure 13:
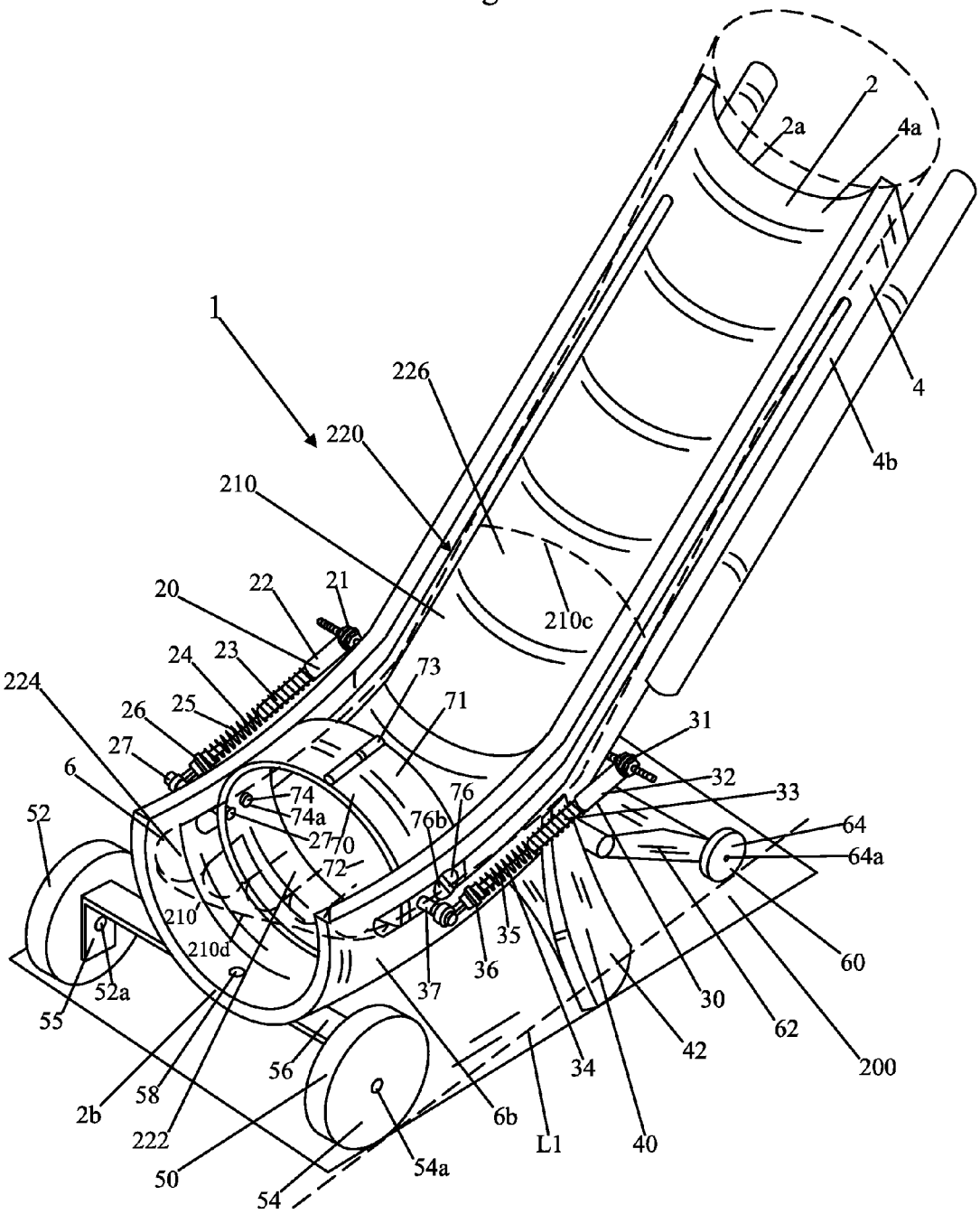
FIG. 13 shows a front, top, right perspective view of an apparatus of FIG. 1A in accordance with an embodiment of the present invention, with the apparatus of FIG. 1A in the first state, placed on the floor or the ground surface and with a foot having a sock on it placed through the first hollow tube.

FIG. 13 shows a front, top, right perspective view of an apparatus 1, with the apparatus 1 in the first state, placed on the floor or the ground surface 200 and with the leg 220 having the sock 210 on a portion of the leg 210 and with a portion of the foot 222 placed through the first hollow tube 71. The leg 220 and the sock 210 are shown by dashed lines in FIG. 13. The sock 210 is placed on the leg 220 so that an open end 210*c* of the sock 210 is pulled up on the ankle portion 226 of the leg 220 as far as the sock 210 can go, and a closed end 210*b* of the sock 210 is in close proximity or in contact with the toes 224 of the leg 220. The foot 222 of the person is within a chamber of the sock 210.

Figure 14:
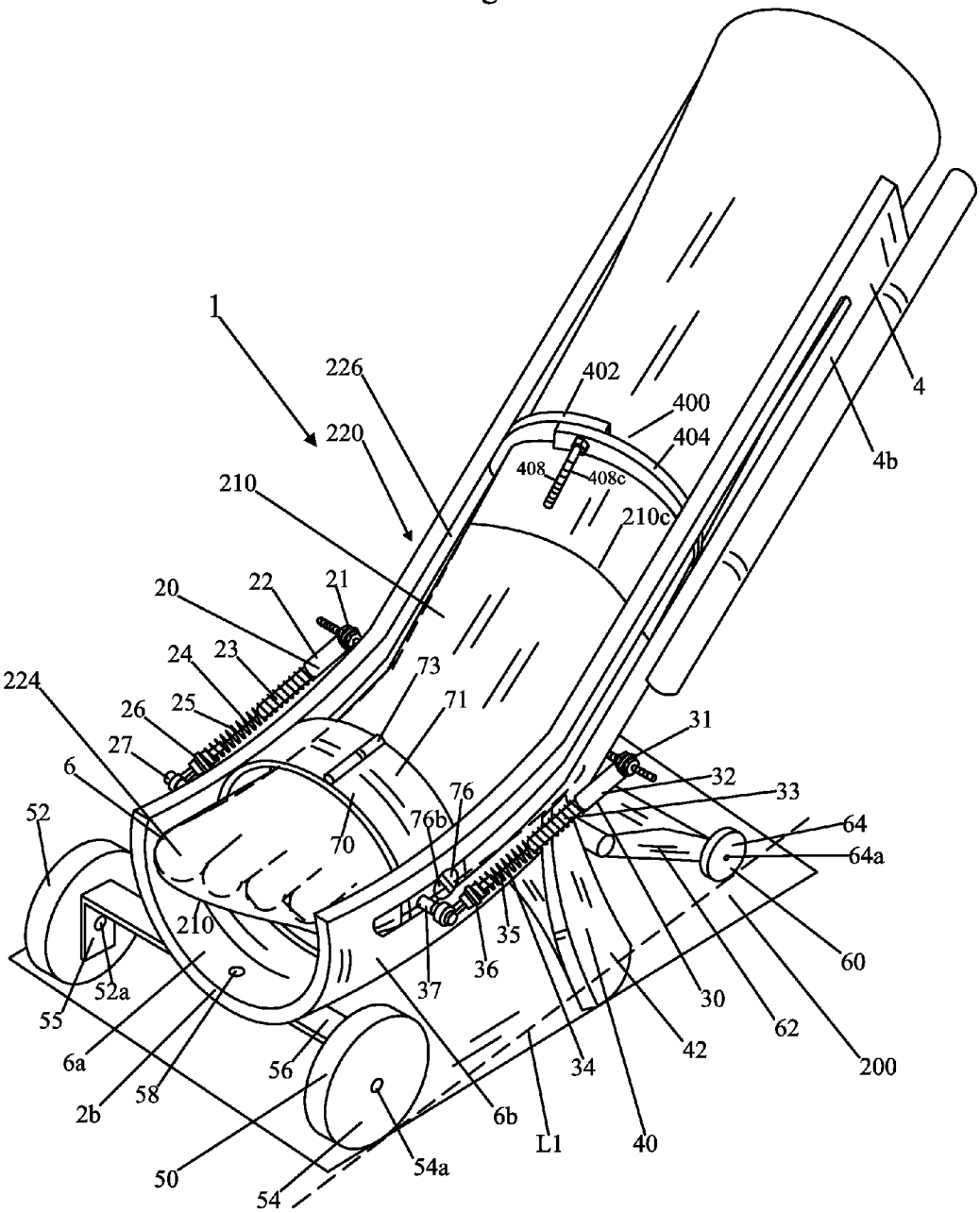
FIG. 14 shows a front, top, right perspective view of the apparatus of FIG. 1A in accordance with an embodiment of the present invention, with the apparatus of FIG. 1A in the first state, placed on the floor or the ground surface, with the foot having a sock on it placed through the first hollow tube, and with a clamping device attached to an ankle portion or a leg portion of a person.

FIG. 14 shows a front, top, right perspective view of the apparatus 1, with the apparatus 1 of FIG. 1A in the first state, placed on the floor or the ground surface 200, with the foot 222 having a sock 210 on it placed through the first hollow tube 71, and with a clamping device 400 attached to part of the ankle portion 226 of the person's leg 220. The clamping device 400 is placed above the open end 210*c* of the sock 210. The clamping device 400, in at least one embodiment is used to take the sock 210 off of the person's leg 220. In FIG. 14, the leg 220 and the sock 210 are shown by dark lines where they can be seen in the view of FIG. 14, and otherwise the configuration of FIG. 14 is the same as the configuration of FIG. 13, except for the attachment of the clamping device 400 to the leg 200 of the person.

FIG. 15 shows a front, top, right perspective view of the apparatus 1 in the second state, placed on the floor or the ground surface 200, with leg 220 having the sock 210 on it, and with the foot 222 placed through the first hollow tube 71, with the clamping device 400 attached to a portion of the ankle portion 226, and with the first hollow tube 71 attached to the clamping device 400.

Figure 17A:
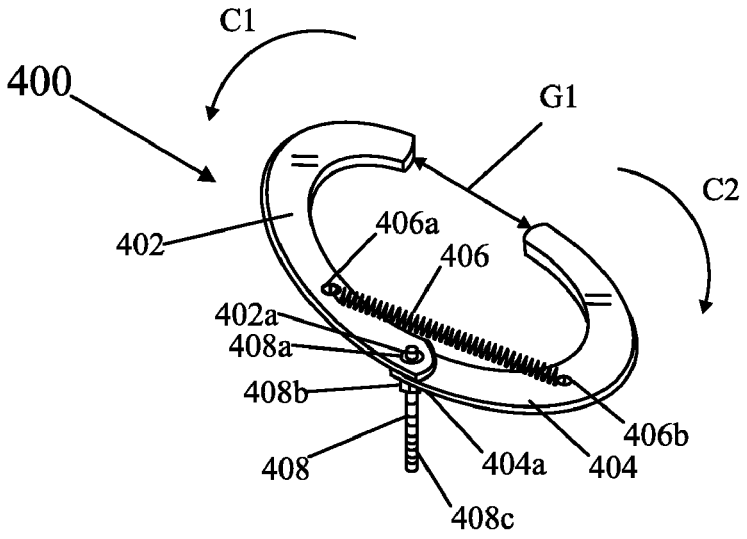
FIG. 17A shows a rear, top, right perspective view of the clamping device shown in FIGS. 14-16.
Figure 17B:
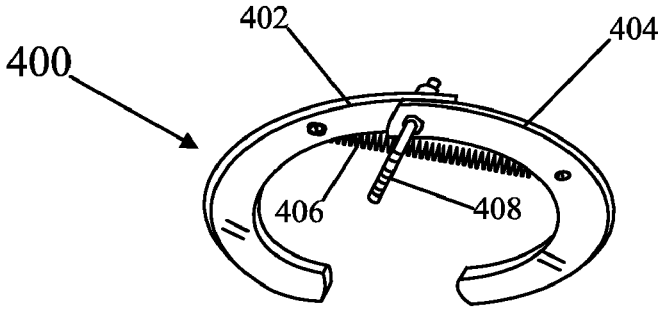
FIG. 17B shows a front, top, right perspective view of the clamping device shown in FIGS. 14-16.

The clamping device 400 includes portions 402 and 404, spring 406, and pin device 408. The spring 406 is fixed to the portions 402 and 404 by connectors or pins 406*a* and 406*b*. The pin device 408 includes nut or cap 408*a*, nut or cap 408*b*, and pin or screw 408*c*. The pin or screw 408*c* connects the portion 402 with the portion 404 so that the portion 402 can pivot with respect to the portion 404. A portion of the pin 408*c* sits in opening 402*a* and a portion of the pin 408*c* sits in the opening 404*a*. The spring 406 causes the portions 402 and 404 to be biased toward a rest state as shown in FIG. 17A. The portions 402 and 404 can be rotated apart to increase the gap G1 to allow the clamping device 400 to be clamped or attached (so that clamping device 400 can slide with sufficient force applied by tube 71). For example, the portion 402 can be rotated in the counterclockwise C1 direction while at the same time the portion 404 is rotated in the clockwise direction C2 to cause the gap G1 to be increased and to allow the clamping device 400 to be attached to the leg 220 as in FIG. 14. Note that in FIGS. 14-16, the spring 406 is hidden behind the portions 402 and 404, and thus is not shown in FIGS. 14-16.

In FIG. 15, the tube 71 has been moved from the position of FIG. 14 in the direction U1 by the device 90 (shown in FIG. 9A), to cause the tube 71 to be in close proximity with the clamping device 400. In addition, the pin or screw 408*c* has been inserted into the tube 73 which is attached to the tube 71, and thereby the clamping device 400 is attached to the tube 70 and will move when the tube 71 is moved by the motor 110.

FIG. 16 shows a front, top, right perspective view of the apparatus 1 in the first state, placed on the floor or the ground surface 200, with the foot 222 placed through the first hollow tube 71, with the clamping device 400 having been slid down and/or pulled down a leg portion of the leg 220 by the motor 110, the device 90, and by the tube 71 to which the clamping device is attached through tube 73 and pin 408*c*. In FIG. 16 the sock 210 has been at least partially taken off of the foot 222. The apparatus 1 may be configured so that the sock 210 is completely taken off of the leg 220, including off of the foot 222, or the sock 210 may be partially removed from the foot 222, and the person may then step out of the inner chamber of the sock 210.

Figure 18:
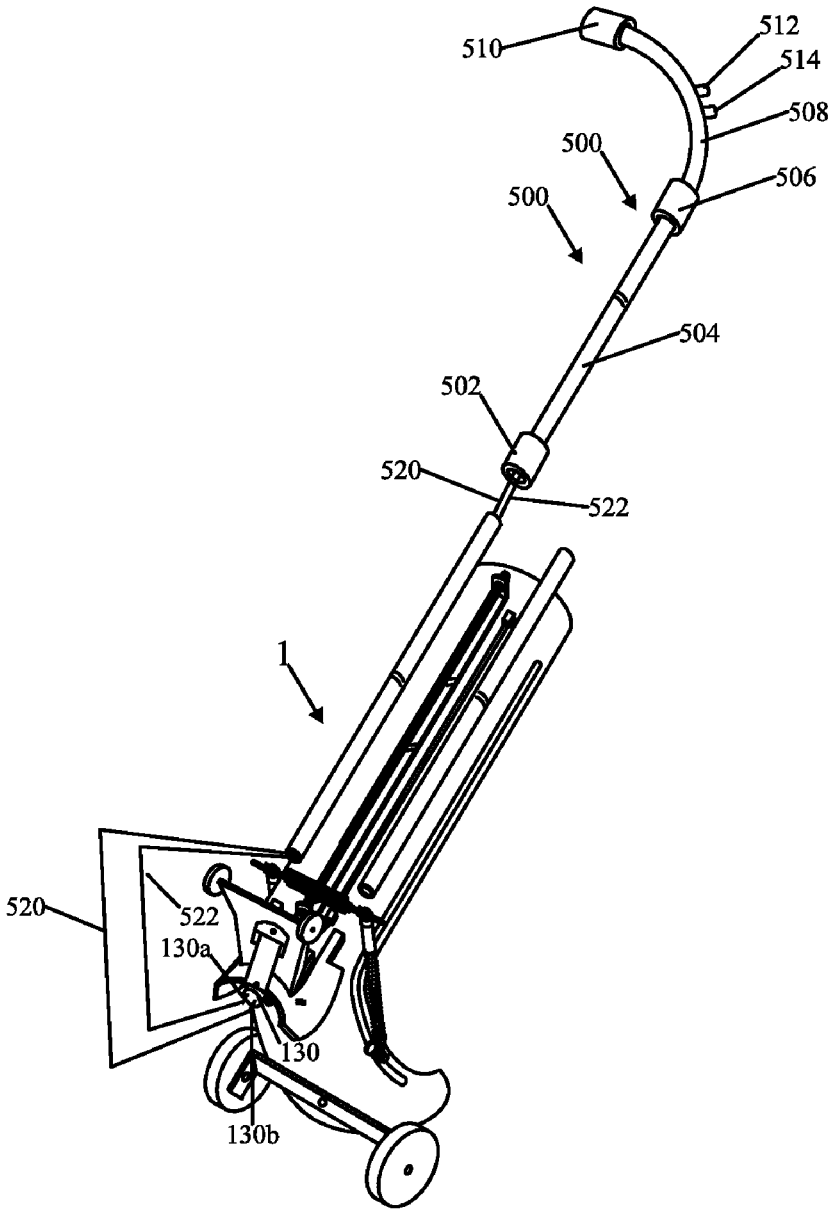
FIG. 18 shows rear, bottom, and left side perspective view of the apparatus of FIG. 1A, with the apparatus of FIG. 1A, in the first state, and with a perspective view of a handle or control device shown detached from the apparatus of FIG. 1A.

FIG. 18 shows rear, bottom, and left side perspective view of the apparatus 1 with the apparatus 1 in the first state, and with a perspective view of a handle or control device 500 shown detached from the apparatus 1. The handle or control device 500 may include hollow cylindrical tubes 502, 504, 506, 508, and 510, and switches 512 and 514. The switch 512 may be or may correspond to switch 302 in FIG. 12 and when pressed or otherwise actuated may cause the device 90 to go up in the direction U1 in response to motor 110 turning the rod 86, which may cause the tube 71 to be pulled upwards in the direction U1. The switch 514 may be or may correspond to switch 304 in FIG. 12 and when pressed or otherwise actuated may cause the device 90 to go down in the direction D1 in response to motor 110 turning the rod 86, which may cause the tube 71 to be pushed downwards in the direction D1.

Figure 19:
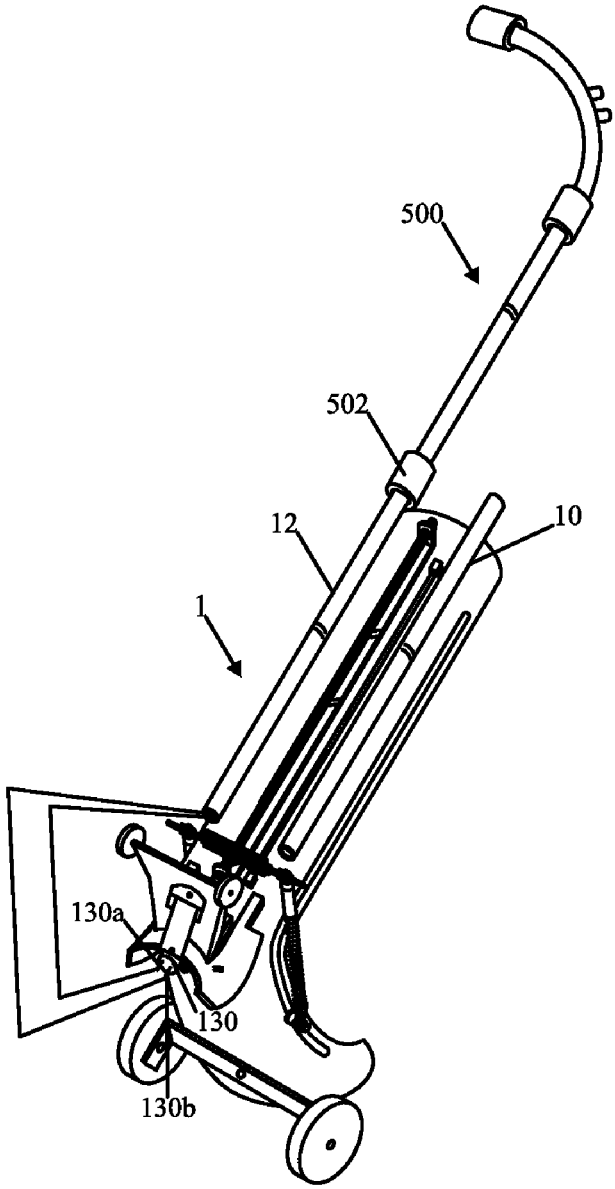
FIG. 19 shows rear, bottom, and left side perspective view of the apparatus of FIG. 1A, with the apparatus of FIG. 1A, in the first state, and with a perspective view of a handle or control device shown attached to the apparatus of FIG. 1A.

FIG. 19 shows rear, bottom, and left side perspective view of the apparatus 1, with the apparatus 1, in the first state, and with a perspective view of the handle or control device 500 shown attached to the apparatus 1. The handle device 500 has been attached so that tube 502 substantially surrounds and is thereby attached to tube 12. In at least one embodiment, the configuration of FIG. 19 may be convenient for a person standing or sitting down, to control the apparatus 1 by switches 512 and 514, with having to lift the handle device 500. The handle device 500 may be attached to the tube 10 instead of tube 12, by attaching tube 502 to tube 10. Attachment of the handle device 500 to the tube 12 may be more convenient and make the apparatus 1 easier to use for putting a left foot onto the section 2 of the apparatus 1 and attachment of the handle device 500 to the tube 10 may be more convenient for putting a right foot onto the section 2 of the apparatus 1.

The terminals 130*a* and 130*b* of the power device 130 may be electrically connected to wires or conductors 520 and 522 respectively, which may be electrically connected to switches 512 and 514 as shown in FIG. 18. Alternatively or additionally the wires 520 and 522 may be electrically connected to an electrical plug which may be plugged into an electrical outlet in order to provided power to motor 110 in order to move device 90 and thereby tube 71 to put on or take off a sock such as sock 210.

As shown in FIG. 5, the apparatus 1, may have a height H1 from the top of tubes 10 and 12 to the surface 200 of about eighteen inches and a width W1 of about four to six inches.

In accordance with at least one embodiment of the present invention, a person may put a sock, such as sock 210 shown in FIGS. 4A-4B, on in the following manner or with the following method.

(a) If desired the handle device 500 can be connected to one of the tubes 10 or 12 as shown by FIG. 19. In at least one embodiment, the handle device 500 would be connected to the tube 10 for placing the sock 210 on the right leg of a person, and the handle device 500 would be connected to the tube 12 for placing the sock 210 on the left leg of a person. In this manner, the handle device 500 does not sit between the two legs of a person, but rather lies outside of the two legs.

(b) In at least one embodiment, the tube 71 can be moved by the motor 110 as far downwards in the direction D1 as is possible, such as for example to the state shown in FIG. 1A, by, for example, pressing the button or switch 304, shown in FIG. 12 (or the switch 514 shown in FIG. 18) to cause the motor 110 to rotate the rod 86 and to thereby causes the device 90 to push the tube 71 downwards in the direction D1.

(c) An individual may next place a sock, such as sock 210, partially through the hollow opening 140*a* of the hollow tube or "sock stay ring" 140. Next the individual wraps a portion 210*b* of the sock 210 near the closed end 210*c* of the sock 210 around a portion the perimeter of the tube 140 as shown in FIGS. 4A and 4B.

(d) An individual may next place the hollow tube or "stock stay ring" 140 partially within the tube 71 as shown in FIG. 4, so that the overlapped portion 210*b* of the sock 210 does not go into the tube 71 and the components 74, 76 prevent the hollow tube 140 from going more than part way, such as half way, into the tube 71. The hollow tube 140 tightly fits within the tube 71 so that it is temporarily attached and when the tube 71 moves the tube 140 moves.

(e) Next an individual may place their foot 222 at least partially through the tube or housing 71 as shown in FIG. 7, so that the at least part of the foot 222 is in a chamber of the sock 210, is into and/or through the tubes 140 and 71.

(f) Next the individual may press the button or switch 302, shown in FIG. 12, or switch 512 shown in FIG. 18, to cause the motor 110 to turn the rod 86 and to thereby cause the device 90 to pull up the tubes 71 and thereby the tube 140. When the tube 71 has moved a sufficient distance in the direction U1, the sock portion 210*b* will automatically snap off or pull off of the tube 140 and snap or band to a portion of the ankle portion 226 of the person's leg 220. After the portion 210*b* of the sock has come off of the tube 140, the button or switch 304 can be pressed to cause the tube 71 and tube 140 to come down in the direction D1.

The steps of (a) through (f) can be repeated to put a sock, which may be identical to sock 210, on another leg of the user.

In accordance with at least one embodiment of the present invention, a person may take a sock, such as sock 210 shown in FIGS. 4A-4B, off in the following manner or with the following method.

(a) The individual may first push the switch 304 to move the tube 71 down in the direction D1, until it is far down the apparatus 1 as possible, such as shown in FIG. 1A. For taking the sock 210 off, the tube 140, in at least one embodiment, is not used.

(b) The individual may next insert a portion of their foot 222 through the tube 71 as shown in FIG. 13, with the sock on 210 on a portion of the leg 220, fully extended up to the closed end 210*c*.

(c) The individual may next place and/or clamp the clamping device 400, as shown in FIG. 14, around or partially around the a portion of the ankle portion 226 of the leg 220 above the sock line or closed sock end 210*c*. The clamping device 400 is typically configured so that the individual will have to increase the gap G1 shown in FIG. 17A by pulling or rotating the portions 402 and 404 apart in the directions C1 and C2, in order to attach to the ankle portion 226.

(d) The individual may next press the switch 302 or 512 to move the tube 71 upwards in the direction U1, until it is in the location shown in FIG. 15. While the tube 71 moves upwards, the pin 408*c* gradually inserts and becomes attached to the tube 73 and thereby to the tube 71. This may be done by a snap fit or snug fit mechanism between pin 408*c* and tube 73. Alternatively, the clamp device 400 can be attached to the leg 220 after the tube 71 is in the position of FIG. 15, and the pin 408*c* can be inserted into the tube 73 after the tube 71 is in the position of FIG. 15.

(e) Next the switch 304 or switch 514 can be pressed or actuated to move the tube 71 and the clamp device 400 (which slides down the leg 220 of the person when pulled down with sufficient force, and which grabs onto or pushes the closed end 210*c* of the sock 210 to gradually push the closed end 210*c* of the sock downwards and also pushes the sock 210 downwards to gradually take the sock 210 off of the leg 220. When the tube 71 has reached the location shown in FIG. 16, the sock 210 is substantially or completely off, and the person can step out of the apparatus 1, such as by removing the leg 220 from the apparatus 1 and from the inner chamber of the sock 210.

The steps (a)-(e) for sock removal shown above can be repeated for the other leg of the person.

The motor 110 shown in FIG. 9A may be a twelve volt two hundred RPM (revolutions per minute) motor.

The apparatus 1 may include lower limit switch 150 and upper limit switch 152 shown in FIG. 9A. The lower limit switch 150 and the upper limit switch 152 may be electrically connected by wires or conductors 152*a* and 152*b*, to the motor 110. In accordance with an embodiment of the present invention when the device 90 is moving in the direction D1, shown in FIG. 9A, the device 90 will eventually come in contact with or otherwise actuate lower limit switch 150. This will cause the motor 110 to automatically shut off and stop turning the rod 86. Similarly, when the device 90 is moving in the direction U1 shown in FIG. 9A, the device 90 will eventually come in contact with or otherwise actuate the upper limit switch 152. This will also cause the motor 110 to automatically shut off and stop turning the rod 86. The lower limit switch 150 and the upper limit switch 152 may be electrically connected by different wires in a circuit with the motor 110 or by the same wires. The lower limit switch 150 and the upper limit switch 152 may be mechanical switches or optical switches or any other suitable known switch in the art.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first subsection having a first top end and a second top end;

a second subsection having a first top end and a second top end;

wherein there is a first line from the first top end of the first subsection to the second top end of the first subsection;

wherein there is a second line from the first top end of the second subsection to the second top end of the second subsection;

and wherein the first line is at a first angle with respect to the second line;

wherein the second top end of the first subsection is fixed to the first top end of the second subsection;

further comprising a first hollow tube; and a device for moving the first hollow tube along the first subsection and the second subsection; and wherein the first hollow tube, the first subsection, and the second subsection are configured so that at least a portion of a foot of a leg of a person, including toes of the foot of the of the leg of a person, can be placed on the second subsection, while an ankle portion of the leg of the person is at the same time placed on the first subsection and while at the same time a portion of the leg of the person lies inside of the first hollow tube.

2. The apparatus of claim 1 wherein the first angle is greater than about ninety degrees.

3. The apparatus of claim 1 wherein the first subsection and the second subsection together form a channel into which the leg of the person can be placed.

4. The apparatus of claim 1 wherein the device for moving the first hollow tube along the first subsection and the second subsection includes a motor.

5. The apparatus of claim 4 wherein the device for moving the first hollow tube along the first subsection and the second subsection includes a threaded rod connected to the motor so that the motor is configured to rotate the threaded rod in order to move the first hollow tube along the first subsection and the second subsection.

6. The apparatus of claim 1 wherein the first subsection is in the shape of a hollow substantially cylindrical tube which has been substantially cut in half; and the second subsection is in the shape of a curved hollow tube which has been substantially cut in half.

7. The apparatus of claim 1 wherein the first subsection has a first slot;

the second subsection has a second slot;

the first slot and the second slot join together in a first overall continuous slot;

and wherein the first hollow tube is moved along the first subsection and the second subsection by the device for moving the first hollow tube via a first pin having a first end which is connected to the first hollow tube and a second end which rides in the first overall continuous slot.

8. The apparatus of claim 7 wherein the first subsection has a third slot;

the second subsection has a fourth slot;

the third slot and the fourth slot join together in a second overall continuous slot;

and wherein the first hollow tube is moved along the first subsection and the second subsection by the device for moving the first hollow tube via a second pin having a first end which is connected to the first hollow tube and a second end which rides in the second overall continuous slot.

9. The apparatus of claim 1 further comprising a first wheel; and a second wheel;

wherein the first and the second wheel are connected to the second subsection so that the first and the second wheel rotate about a first axis with respect to the second subsection.

10. The apparatus of claim 9 further comprising a third wheel; and a fourth wheel;

wherein the third and the fourth wheel are connected to second subsection a distance away from the first wheel and the second wheel, so that the third and the fourth wheel rotate about a second axis with respect to the second subsection.

11. The apparatus of claim 10 further comprising a stabilizing device which extends between the first axis and the second axis, so that when the first wheel and the second wheel are in contact with a ground surface, the third wheel and the fourth wheel are prevented from making contact with the ground surface by the stabilizing device.

12. A method comprising:

using an apparatus to put a sock on a leg of a person;

wherein the apparatus includes:

a first subsection having a first top end and a second top end;

a second subsection having a first top end and a second top end;

wherein there is a first line from the first top end of the first subsection to the second top end of the first subsection;

wherein there is a second line from the first top end of the second subsection to the second top end of the second subsection;

and wherein the first line is at a first angle with respect to the second line;

wherein the second top end of the first subsection is fixed to the first top end of second subsection;

and wherein the apparatus further includes a first hollow tube; and a device for moving the first hollow tube along the first subsection and the second subsection; and and wherein the method further includes placing at least a portion of a foot of the leg of the person, including toes of the foot of the leg of a person, on the second subsection, while an ankle portion of the leg of the person is at the same time placed on the first subsection and while at the same time a portion of the leg of the person lies inside of the first hollow tube;

and further comprising attaching the sock to the first hollow tube;

and moving the first hollow tube to cause the sock to be put on the leg of the person.

13. The method of claim 12 further comprising moving the first hollow tube to cause the sock to be taken off of the leg of the person after the sock has been put on the leg of the person.

14. The method of claim 12 wherein the first subsection and the second subsection together form a channel into which the leg of the person can be placed.

15. The method of claim 12 wherein the device for moving the first hollow tube along the first subsection and the second subsection includes a motor.

16. The method of claim 15 wherein the device for moving the first hollow tube along the first subsection and the second subsection includes a threaded rod connected to the motor so that the motor is configured to rotate the threaded rod in order to move the first hollow tube along the first subsection and the second subsection.

17. The method of claim 12 wherein the first subsection is in the shape of a hollow substantially cylindrical tube which has been substantially cut in half; and the second subsection is in the shape of a curved hollow tube which has been substantially cut in half.

18. The method of claim 12 wherein the first subsection has a first slot;

the second subsection has a second slot;

the first slot and the second slot join together in a first overall continuous slot;

and wherein the first hollow tube is moved along the first subsection and the second subsection by the device for moving the first hollow tube via a first pin having a first end which is connected to the first hollow tube and a second end which rides in the first overall continuous slot.

19. The method of claim 18 wherein the first subsection has a third slot;

the second subsection has a fourth slot;

the third slot and the fourth slot join together in a second overall continuous slot;

and wherein the first hollow tube is moved along the first subsection and the second subsection by the device for moving the first hollow tube via a second pin having a first end which is connected to the first hollow tube and a second end which rides in the second overall continuous slot.

20. The method of claim 12 wherein the apparatus includes a first wheel; and a second wheel;

wherein the first and the second wheel are connected to the second subsection so that the first and the second wheel rotate about a first axis with respect to the second subsection.

21. The method of claim 20 wherein the apparatus includes a third wheel; and a fourth wheel;

wherein the third and the fourth wheel are connected to second subsection a distance away from the first wheel and the second wheel, so that the third and the fourth wheel rotate about a second axis with respect to the second subsection.

22. The method of claim 21 wherein the apparatus further includes a stabilizing device which extends between the first axis and the second axis, so that when the first wheel and the second wheel are in contact with a ground surface, the third wheel and the fourth wheel are prevented from making contact with the ground surface by the stabilizing device.

* * * * *